United States Patent [19]

Oishi

[11] 3,993,486

[45] Nov. 23, 1976

[54] DIFFUSION TRANSFER COLOR PHOTOGRAPHIC FILM UNIT WITH COMPOSITE OF IMAGE-RECEIVING ELEMENT WITH LIGHT INTERCEPTING ELEMENT

[75] Inventor: Yasushi Oishi, Minami-ashigara, Japan

[73] Assignee: Fuji Photo Film Co., Ltd., Minami-ashigara, Japan

[22] Filed: June 4, 1974

[21] Appl. No.: 476,241

[30] Foreign Application Priority Data

June 4, 1973 Japan ..... 48-63157

[52] U.S. Cl. ..... 96/29 D; 96/3; 96/73; 96/76 C; 96/77; 96/84 R; 96/119 R; 428/223; 428/262

[51] Int. Cl.[2] ..... G03C 7/00; G03C 5/54; G03C 1/48; G03C 1/40

[58] Field of Search ..... 96/77, 76 C, 3, 29 D, 96/73, 119 R, 84 R; 428/223, 262

[56] References Cited

UNITED STATES PATENTS

| | | | |
|---|---|---|---|
| 3,415,644 | 12/1968 | Land | 96/3 |
| 3,586,501 | 6/1971 | Norquist et al. | 96/76 C |
| 3,615,421 | 10/1971 | Land | 96/3 |

*Primary Examiner*—David Klein
*Assistant Examiner*—Richard L. Schilling
*Attorney, Agent, or Firm*—Sughrue, Rothwell, Mion, Zinn & Macpeak

[57] ABSTRACT

A diffusion transfer color photographic film unit, (a) which contains:

1. a light-sensitive element comprising a support having thereon at least one light-sensitive silver halide emulsion layer having associated therewith a dye image-forming material which, as a result of development, forms an imagewise distribution of a dye image-forming material capable of diffusing through a processing solution;
2. an image-receiving element comprising a transparent support having thereon an image-receiving layer for receiving the dye image-forming material upon diffusion;
3. a light-intercepting element having substantially the same area as the image-receiving element and being capable of protecting an emulsion layer or layers from external light during processing of the film unit in a bright place out of a camera;
4. a rupturable container retaining an alkaline processing solution and capable of spreading the processing solution between the emulsion layer and the image-receiving layer in a layer form upon rupture by means of pressure-applying members; and
5. a light-reflecting substance in an amount sufficient to form a white background for the transferred dye images, the light-reflecting substance being either positioned between the image-receiving layer and the light-sensitive emulsion layer of the light-sensitive element or introduced therebetween upon spreading of the processing solution, b. in which the image-receiving element and the light-intercepting element are relatively fixed at least at one edge in a parallel face-to-face alignment, with the image-receiving layer directed inside, to form a composite having an opening for introducing a light-sensitive element therebetween so that the image-receiving layer faces the light-sensitive emulsion layer of the light-sensitive element, and c. which is adapted to be passed, after imagewise exposure of the light-sensitive element and introduction of the light-sensitive element through the opening of the composite, through pressure-applying members.

50 Claims, 13 Drawing Figures

FIG. 1
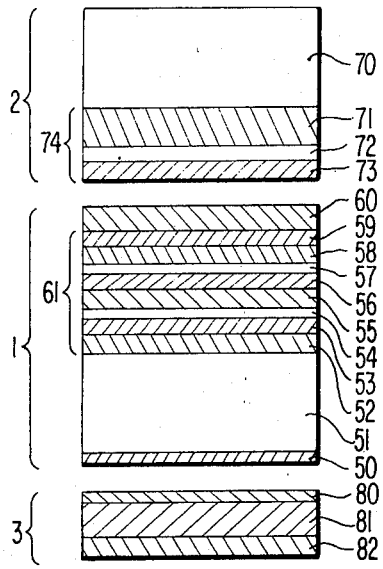
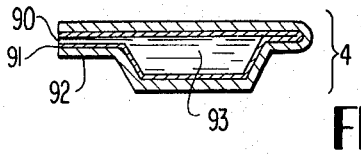
FIG. 1a
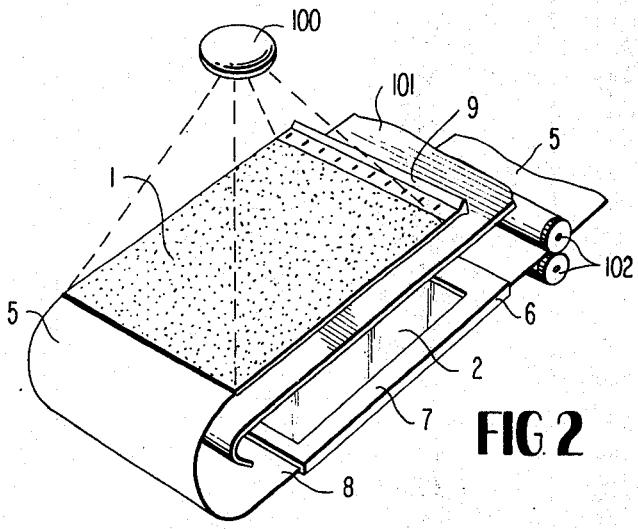
FIG. 2
FIG. 3
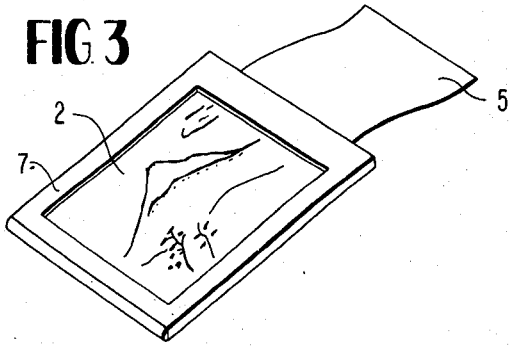
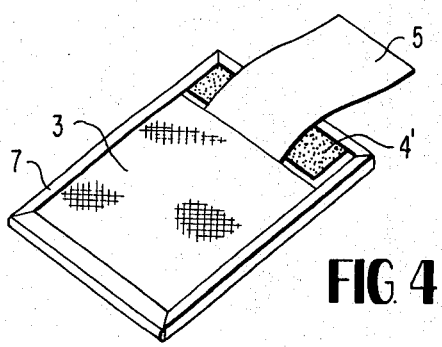
FIG. 4
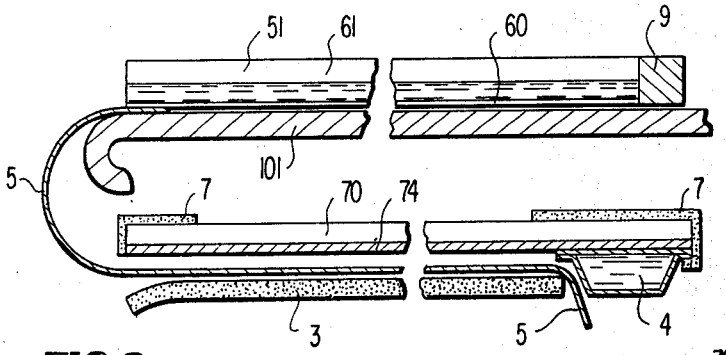
FIG. 9
FIG. 10
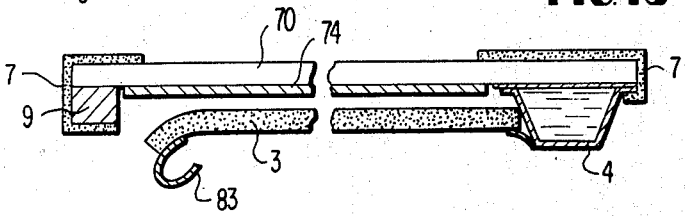

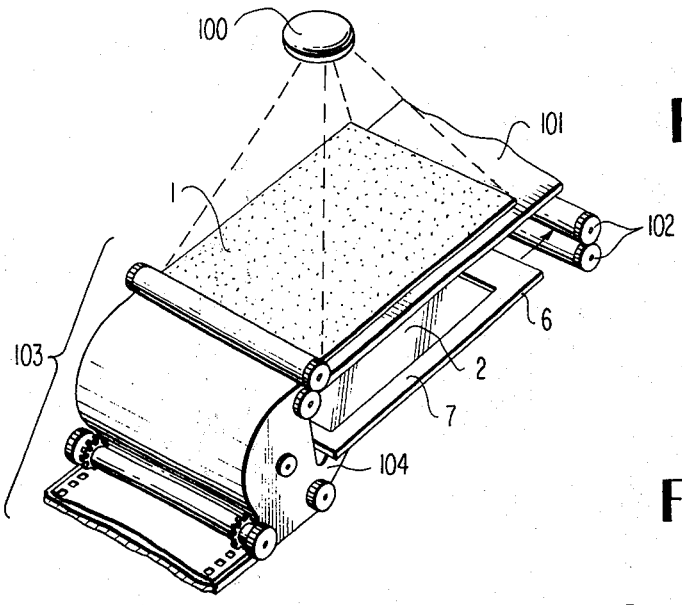
FIG. 5
FIG. 6
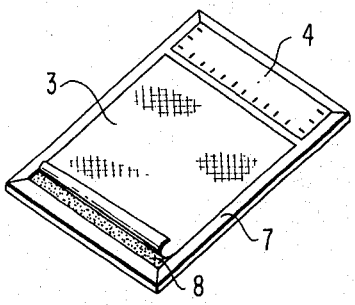
FIG. 7
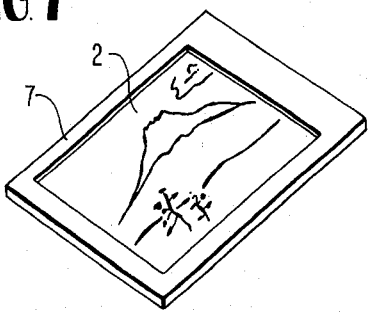
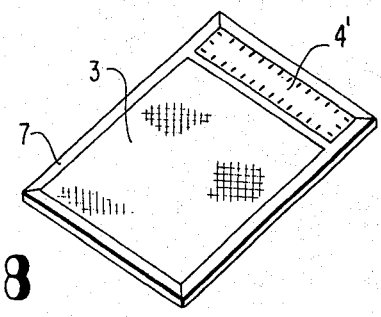
FIG. 8
FIG. 11
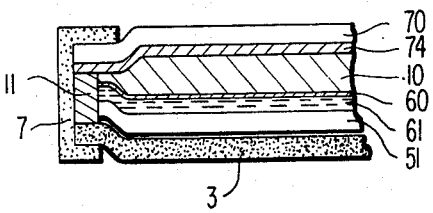
FIG. 12
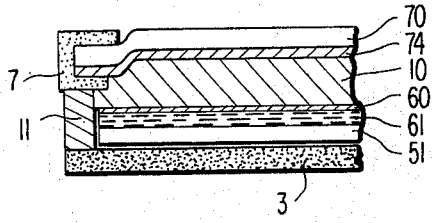

DIFFUSION TRANSFER COLOR PHOTOGRAPHIC FILM UNIT WITH COMPOSITE OF IMAGE-RECEIVING ELEMENT WITH LIGHT INTERCEPTING ELEMENT

BACKGROUND OF THE INVENTION

1. Field of the Invention

The present invention relates to a film unit for use in diffusion transfer color photography and, more particularly, it relates to a diffusion transfer color photographic film unit which can be imagewise exposed in a camera and can be processed in a bright place outside the camera while permitting the formation of the image to be observed.

2. Description of the Prior Art

The so-called diffusion transfer color photography, in which a silver halide emulsion is used as a light-sensitive element and imagewise distributed diffusible dyes are formed as a result of the development of exposed silver halide grains and are allowed to diffuse into another hydrophilic colloidal layer followed by fixation, has the advantage that, since dye images are formed in a place remote from where silver deposits and residual silver halide exist, after-treatments such as fixing and bleaching are not necessary and color images can be obtained by only one developing step. Furthermore, a film unit which, after imagewise exposure in a camera and subsequent contact with a processing composition, can immediately be withdrawn from the camera with the light-sensitive element being maintained in a light-intercepting state and can be processed in a bright place, and a film unit which enables the observation of the degree of the formation of the diffusion transfer image in a bright place and which can be stored without separating an image-receiving layer have been suggested.

In film units as described in U.S. Pat. Nos. 3,415,644, 3,573,043 and 3,615,421, the images are formed on the same side as the side exposed in a camera. An image-inverting optical system must be used with these film units to obtain photographic images which are not inverted. Therefore, the structure of the camera is special and complicated, and special considerations on maintaining the accuracy of the focus are required.

On the other hand, film units having a structure in which photographic images are formed on the back side of the surface exposed are advantageous in that these units can be employed with cameras of the commonly used type. However, with the film units of this type, both sides of the light-sensitive element must be shielded from light during processing. The opposite surface of the light-sensitive element to that to be exposed can be shielded from light by covering the surface with a processing solution permeable layer containing carbon or a like light absorbent, whereas the surface of the light-sensitive element to be imagewise exposed needs such means which does not diffuse or absorb light during imagewise exposure but which, during processing in a bright place, can completely intercept intense light. One example of a means for intercepting light so that it does not reach the exposed surface of the film unit upon processing is a light-intercepting sheet attached to one end of the film unit, as illustrated in U.S. Pat. Nos. 3,415,645 and 3,415,646. During imagewise exposure, this sheet is turned over from the surface to be exposed and, upon the distribution of the processing solution, it is superposed on the exposed surface to cover the exposed surface. However, the movement of a light-intercepting sheet in a camera imposes many technical difficulties, for example, a large space is required inside the camera, the mechanism of the camera is complicated and the structure of the cassette retaining a film unit is complicated.

Another example of a means for intercepting light so that it does not reach the exposed surface of a film unit is an approach in which a processing solution containing a light absorbent is spread on the exposed surface of a light-sensitive element, as illustrated in U.S. Pat. No. 3,635,707. However, this method cannot be applied to the stratum structure to be used in the present invention in which an image-receiving element and a light-sensitive element are coated on different transparent supports, although it can be applied to a film unit having a stratum structure in which the image-receiving element and the light-sensitive element are coated, one over the other, on the same support.

SUMMARY OF THE INVENTION

An object of the present invention is to provide a film unit which can be imagewise exposed in an ordinary camera which does not contain an image-inverting optical system and which can be with-drawn, after imagewise exposure, from a camera into a bright place to view the appearance of non-inverted normal images.

Another object of the present invention is to provide a film unit which can provide transferred images maintaining a great absorbance difference (the difference between the maximum density and the minimum density) even when processed in a bright place.

A further object of the present invention is to provide a film unit which can be exposed in a camera and processed out of the camera and which does not require the image-receiving element to be separated from the light-sensitive element after processing or which does not require the timing of development.

Still a further object of the present invention is to provide a diffusion transfer image-receiving element having a means to intercept external light from the reverse side of the light-sensitive element while the image-receiving element is in contact with the light-sensitive element during processing.

Still a further object of the present invention is to provide a film unit which enables the light-sensitive element to be exposed in a camera with good planarity.

Still a further object of the present invention is to provide a film unit in which a plurality of film units can be held in a camera at the same time and in which the film units can be withdrawn one by one from the camera through pressure-applying members in a simple operation.

These and other objects of the present invention will become apparent from the following detailed description and examples.

It has now been found that these objects can be attained by the film unit having the following structure, that is, by a diffusion transfer color photographic film unit, a. which contains:

1. a light-sensitive element comprising a support having thereon at least one light-sensitive silver halide emulsion layer having associated therewith a dye image-forming material which, as a result of development, forms an imagewise distribution of a dye image-forming material capable of diffusion through a processing solution;

2. an image-receiving element comprising a transparent support having thereon an image-receiving layer;
3. a light-intercepting element having substantially the same area as the image-receiving element and being capable of protecting an emulsion layer or layers from external light during development-processing of the film unit in a bright place out of a camera;
4. a rupturable container retaining an alkaline processing solution and capable of spreading the processing solution between the emulsion layer and the image-receiving layer in a layer form upon being ruptured by means of pressure-applying members; and
5. a light-reflecting substance in an amount necessary to form a white background for transferred dye images, which is either positioned between the image-receiving layer and the emulsion layer of the light-sensitive element or introduced by the spreading of the processing solution, b. in which the image-receiving element and the light-intercepting element are relatively fixed at least at one edge in a parallel face-to-face alignment, with the image-receiving layer of the image-receiving element directed inside, to form a composite having an opening for introducing the light-sensitive element therebetween so that the image-receiving layer faces the emulsion layer, and c. which is adapted to be passed, after imagewise exposure of the light-sensitive element in a camera and introduction of the light-sensitive element through the opening between the image-receiving element and the light-intercepting element, through pressure-applying members.

BRIEF DESCRIPTION OF THE DRAWINGS

FIG. 1 shows a cross-sectional view of the light-sensitive element, image-receiving element, light-intercepting element and the processing solution container used in the present invention.

FIG. 2 is a perspective view showing the disposition of one film unit of the present invention being exposed in a camera.

FIG. 3 is a perspective view showing the print side of the film unit after processing.

FIG. 4 is a perspective view showing the back side of the film unit after processing.

FIG. 5 is a perspective view showing the disposition of another film unit of the present invention being exposed in a camera.

FIG. 6 is a perspective view showing the back side of the image-receiving element/light-intercepting element composite of the film unit.

FIG. 7 is a perspective view showing the print side of the film unit after processing.

FIG. 8 is a perspective view showing the back side of the film unit after processing.

FIG. 9 shows the cross-sectional view of the film unit illustrated in FIG. 2.

FIG. 10 shows the cross-sectional view of the composite illustrated in FIG. 6.

FIG. 11 shows the cross-sectional view of one film unit of the present invention in which a processing solution has been spread.

FIG. 12 shows the cross-sectional view of another film unit of the present invention in which a processing solution has been spread.

DETAILED DESCRIPTION OF THE INVENTION

In the film unit of the present invention, the light-sensitive element is imagewise exposed in a camera through the transparent support thereof, and then introduced into a composite comprising an image-receiving element and a light-intercepting element through the opening of the composite. In this occasion, the light-sensitive element is introduced in such manner that the support is in contact with the light-intercepting element and the emulsion layer is in contact with the image-receiving element. After the introduction into the composite, the light-sensitive element must be substantially completely shielded from light from the support side. In the state where the light-sensitive element is introduced into the composite, the film unit of the present invention is in a relationship analogous to an envelope containing a card. The film unit in which the light-sensitive element, the image-receiving element and the light-intercepting element are thus unified is passed through pressure-applying members. As a result of this operation, the processing solution container is ruptured to spread the processing solution between the light-sensitive element and the image-receiving element in a layer form, with the development of the emulsion layer or layers and the formation of transferred images thus being initiated. In many cases, the film unit is withdrawn from a camera into a bright place at this stage. On this occasion, a light-reflecting substance is distributed in a layer form between the image-receiving layer and the emulsion layer in an amount necessary to form a white background for the transferred images. With this light-reflecting substance-containing layer as a background, the formation of the transferred images is observed as the processing progresses. During the processing, the emulsion layer or layers are protected from light from the support side by the light-intercepting element. On the other hand, external light from the image-receiving element side is reflected and diffused by the layer containing a light-reflecting substance, thereby being weakened in effect.

In addition to the above-described necessary components, the film unit of the present invention preferably contains, between the image-receiving layer and the emulsion layer of the light-sensitive element, a light absorbent in order to protect the emulsion layer or layers more completely from the light from the image-receiving element side. One preferable method for disposing the light absorbent is to add a dye to the processing solution containing a light-reflecting substance, this dye becoming colorless on completion of the processing. U.S. Pat. No. 3,647,437 describes dyes advantageously usable for this method. Another preferable disposition of the light absorbent is that in which the opposite surface of the emulsion layer of the light-sensitive element to the support of the light-sensitive element is covered by a light-intercepting layer which contains a light absorbent and permits permeation of the processing solution, as described in co-pending U.S. Patent Application Ser. No. 470,488, filed May 16, 1974 (corresponding to Japanese Patent Application No. 54454/73). In this case, it is advantageous to spread the light-reflecting substance on the light-intercepting layer together with the processing solution or to incorporate the light-reflecting substance in advance in the processing solution permeable layer on the opposite surface of the image-receiving layer to the support.

The film unit of the present invention advantageously contains, in addition to the above-described necessary components, a transparent neutralizing layer containing an acid in an amount sufficient to neutralize, after the substantial formation of the transferred image, the alkali contained in a processing solution to a pH value at which the dye images are stable. This neutralizing layer is preferably positioned either between the transparent support of the light-sensitive element and the emulsion layer of the light-sensitive element or between the transparent support of the image-receiving element and the image-receiving layer, or both.

In the composite of the image-receiving element and the light-intercepting element used in the present invention, the image-receiving element is relatively fixed to the light-intercepting element at least at one edge or end in a planar parallel relationship, with the image-receiving element directed inside the assembled composite, and an opening is formed along one end of the composite in order to introduce the light-sensitive element. It is advantageous to relatively fix both elements with a gap corresponding to the thickness of the light-sensitive element so as to be able to introduce the exposed light-sensitive element smoothly between the two elements of the composite. For this purpose, it is preferable to insert a spacing member between both of the elements along the fixed ends or edges. Also, the surface of each element to be in contact with the light-sensitive element is preferably subjected to a processing which reduces friction (e.g., application of a lubricant containing layer such as a layer which contains a polyorganosiloxane, a fluorocarbon polymer, graphite, graft carbon, etc.) to thereby facilitate the smooth introduction of the light-sensitive element. Furthermore, in order to prevent disadvantageous electrostatic marks of the silver halide emulsion from occurring due to static electricity generated by the friction upon introduction of the light-sensitive element into the composite, it is advantageous to subject the surface of each element to be in contact with the light-sensitive element to an antistatic processing. In particular, antistatic processing of the surface of the support of a light-sensitive element and of the inside surface of the light-intercepting element and the addition of an ultraviolet light-absorbing agent to a backing layer or transparent support of the light-sensitive element have been found to be effective.

The binding of edges to form the composite of the image-receiving element and the light-intercepting element can be attained using various methods. Illustrative preferable methods are a direct binding using an adhesive containing a volatile solvent, an adhesive suitable for heat sealing or a thermosetting polymer adhesive, and binding using a pressure-sensitive tape having thereon a layer of the above described adhesive. Furthermore, a binding system in which the edges of the composite are wrapped with a light-intercepting, pressure-sensitive tape is particularly useful since this system prevents, at the same time, light from leaking into the light-sensitive element introduced through one end of the composite.

The composite has an opening along the leading end, side edges or rear end thereof for the introduction of the light-sensitive element. The terms "leading", "side" and "rear", as used herein are designated with respect to the direction which the film unit travels in relation to the pressure-applying members.

In the step of forming transferred images using the film unit of the present invention, the exposed light-sensitive element is appropriately introduced into the composite.

One useful method is to use a leading member such as a leader film or a leader paper. In this method, a leading member connected to one end of the light-sensitive element penetrates the composite in such manner that the member passes through a first opening of the composite for introducing the light-sensitive element, between the image-receiving element and the light-intercepting element, and then through a second opening formed along the opposite end to the first opening. After photographing and exposure, the light-sensitive element is introduced into the composite by pulling the leading member while maintaining the composite stationary. It is preferable to provide the film unit with a stopper or like means to fix, at this time, the light-sensitive element at a suitable position in the composite.

In another useful method for introducing the light-sensitive element, the exposed light-sensitive element is carried by a movable member of a camera or a film cassette and pushed into the composite through a slit positioned in the vicinity of the opening of the composite. In this case, the light-sensitive element and the image-receiving and light-intercepting elements need not be connected with each other before exposure. However, since they are used as a pair, they are regarded as one unit, i.e., a film unit.

The necessary light-intercepting ability of the light-intercepting layer used in the present invention varies depending upon the end use purpose of the film unit, the light sensitivity of the silver halide, or like factors. However, generally speaking, the layer advantageously possesses an absorbance of not less than about 5, preferably not less than 7, to light in the ultraviolet, visible and near-infrared regions, in particular, over the entire wavelength region of about 300 to 750 m$\mu$. As the light-intercepting element, advantageously a dimensionally stable layer containing carbon black or a like light absorbent, in particular, a layer as described in U.S. Pat. Nos. 3,607,818 and 3,376,149, a paper containing carbon black, a polymer sheet having coated thereon a carbon black-containing polymer layer, and the like can be used. A dimensionally more stable light-intercepting layer can be prepared from a metal foil of aluminum, tin or the like, a laminated film of a metal foil and a polymer, a film of polyethylene terephthalate or a like polymer having aluminum or like metal vacuum-deposited thereon, or a laminated film. From the viewpoint of fine appearance, it is preferable to cover the outer surface of the light-intercepting element with a layer containing titanium dioxide or a like light-reflecting substance.

In the film unit of the present invention, a processing solution container is preferably positioned, when the film unit passes the pressure-applying members, at the leading end thereof so that the processing solution retained in the container can be spread between the image-receiving layer and the emulsion layer of the light-sensitive element introduced into the composite. The projection of the processing solution container is preferably positioned on the back side of the unit (i.e., the light-intercepting side), from the viewpoint of fine appearance of the processed prints. The processing solution can be contained in the film unit by fixedly positioning the container in advance in the vicinity of the lading end of the composite, by fixedly positioning the container at one end of the light-sensitive element so that the container lies, upon introduction of the light-sensitive element into the composite, on the leading end of the film unit.

In order to spread the processing solution in a specified thickness between the image-receiving element and the light-sensitive element, it is desirable to provide the film unit with a separation means to provide a specified gap or space between both elements. For this purpose, it is advantageous to provide a spacer on both side edges of the film unit. This spacer can be positioned either between both elements or outer edges of the image-receiving element. Spacers positioned outside the image-receiving element expand the image-receiving element of the area where the solution is spread to the extent of its thickness. Spacers positioned outside the image-receiving element advantageously function as a frame or border for the prints. Also, spacers positioned outside the light-intercepting layer similarly separates the light-intercepting element and the light-sensitive element to provide a gap for spreading the processing solution. Furthermore, a space-maintaining member for the introduction of the light-sensitive element into the composite also serves as a spacer. These spacers are selected so that they enable the processing solution to be spread in a layer of a thickness of about 20 $\mu$ to 400 $\mu$, preferably 50 $\mu$ to 250 $\mu$.

In order to distribute the processing solution over the entire specified area between the light-sensitive element and the image-receiving element, it is advantageous for excess processing solution based on the amount calculated from the specified solution thickness and the specified spreading area, in particular, in an amount of about 1.05 to 2.5 times as much as the amount necessary, to be present in the container. It is desirable to provide, at the rear end of the film unit, means which receives the excess processing solution to thereby completely prevent the user of the film unit from being injured or his hands or clothes stained due to a leakage of the alkaline processing solution from the unit. For this purpose, a plate-like material containing honeycomb-like pores or a sponge-like or fibrous porous material, capable of absorbing or retaining excess solution, is useful. Furthermore, a reservoir which also functions to neutralize the excess processing solution, as described in U.S. Pat. Nos. 3,615,436 and 3,761,269, is particularly useful.

In the film unit of the present invention, the light-sensitive element remains outside the composite of the image-receiving element and the light-intercepting element before completion of imagewise exposure. Under this condition, the light-sensitive element and the composite of the image-receiving element and the light-intercepting element can be in various spatial relationships with each other in a camera. In one example of a spactial relationship, it is preferable to dispose the pair of the light-sensitive element and the composite of the image-receiving element and the light-intercepting element in a planar parallel alignment, so that the camera is compact and can contain a plurality of film units. On this occasion, the light-sensitive element is disposed with its transparent support directed toward the lens of the camera, and the composite with the image-receiving element directed thereto. In this disposition, the exposed light-sensitive element is carried in a U-form by the aforesaid leading means and is slid into the composite.

Where a plurality of film units of the present invention are simultaneously placed in a camera and a stack of film units is exposed one by one, the opposite surface of the light-sensitive element to the support thereof is advantageously covered with a light absorbent-containing layer, in particular, by a processing solution permeable light-intercepting layer as described in copending U.S. Patent Application Ser. No. 470,488, filed May 16, 1974 (corresponding to Japanese Patent Application No. 54454/73).

The dye image-forming material which can used in the present invention is a compound which, as a result of development of an imagewise exposed silver halide emulsion, provides a two-dimensional distribution of diffusing dyes in accordance with the exposure. Various dye image-forming materials capable of forming diffusible dyes upon development of silver halide based on various systems are known. Examples of such systems are (i) a system in which the dye image-forming materials undergo a change in diffusibility as a result of the oxidation with silver halide: (ii) a system in which the dye image-forming materials react with an oxidation product oxidized by the silver halide to release diffusible dyes; and (iii) a system in which the oxidized dye image-forming materials react with an auxiliary agent to release diffusible dyes. With these systems, oxidation with silver halide directly leads to the formation of diffusible dyes. In addition, there are (iv) a system in which limited amounts of developing agents are used and part of the developing agents not consumed in the development are allowed to move to the image-receiving layer and are there converted to dyes; (v) a system in which limited amounts of developing agents are used and part of the developing agents not consumed in the development react with the dye image-forming materials to provide diffusible dyes; (vi) a system in which an ingredient capable of reacting with the oxidation product of the developing agent, such as a coupler, is used in a limited amount and the reactive ingredient remaining after the reaction following the development moves into the image-receiving layer and is converted into dyes; and (vii) a system in which silver ions obtained from silver halide not consumed in the development are reacted with the dye image-forming materials to provide diffusible dyes. With these systems, ingredients not consumed in the development and in the reaction subsequent to the development are utilized to form images of diffusible dyes. Furthermore, there is (viii) a system in which a mordant is formed or destroyed around the silver halide grains by the development of the grains, thereby fixing or releasing diffusible dyes.

For the dye image-forming material of the invention to be used in diffusion transfer color photography, a complete dye structure moiety can exist, or the dye structure moiety can be formed in the development and the concurring subsequent step. Alternatively, ingredients necessary for forming dyes can be allowed to migrate into the image-receiving layer, with the dyes being formed there.

The dye image-forming materials themselves for use in diffusion transfer color photography in accordance with the present invention are desirably non-diffusible during the steps of production, storage and imagewise exposure of the light-sensitive materials. However, in the steps of development and diffusion transfer, they can have various types of diffusibilities depending upon the system of forming the dye image distribution. In one system, for example, a dye image-forming material soluble and diffusible in the processing composition undergoes a reduction in diffusibility as a result of the development and is fixed whereas the non-developed dye image-providing material is transferred to the image-receiving layer. In another system, the dye image-forming material, which itself is non-diffusible in the processing solution, releases a diffusible dye or a diffusible dye precursor as a result of the development.

In the present invention, dye image-forming materials based on various combinations of the above-described systems for development and conversion to dyes, the above-described steps of forming the dye structure moiety and the diffusibility, can be used. Particularly useful dye image-forming materials are as follows:

a. Dye developers;

As is described in U.S. Pat. No. 2,983,606, a dye developer is a compound which possesses both a dye structure moiety and a silver halide developing group in the same molecule. When this dye developer and an alkali are applied to imagewise exposed silver halide emulsions, a reduction of the silver halide and an oxidation of the color developer occur concurrently. The oxidized dye developer possesses less solubility and less diffusibility in a processing composition as compared with the reduced form of the original dye developer and therefore is fixed in the vicinity of the reduced silver halide. In a preferable embodiment, the dye developer possesses at least one dissociative group which renders the dye developer substantially insoluble in an acidic or neutral aqueous medium but renders the dye developer soluble and diffusible in the alkaline processing composition. Such a dye developer can be incorporated in a light-sensitive element, in particular, in the silver halide emulsion layers or adjacent layers. When diffusion transfer is conducted from a light-sensitive element having two or more light-sensitive units, in which a silver halide emulsion and a dye developer having the corresponding absorption characteristics to the light-sensitive wavelength region of the silver halide emulsion are combined, into one image-receiving element, multi-color positive images can be obtained through one development processing. The light absorption of the dye developer is advantageously that which enables color based on subtractive color photography to be reproduced, i.e., that which provides yellow, magenta or cyan images. The dye structure moiety which provides such an absorption can be derived from azo dyes, anthraquinone dyes, phthalocyanine dyes, nitro dyes, quinoline dyes, azomethine dyes, indamine dyes, indoaniline dyes, indophenol dyes, azine dyes, etc.

On the other hand, the silver halide-developing group represents a group capable of reducing light-exposed silver halide, preferably, represents a group which, as a result of oxidation, loses its ability to become soluble in alkaline solution. In general, a benzenoid developing group, i.e., an aromatic developing group which, upon being oxidized, forms a benzenoid structure is suitable. A preferred developing group is a hydroquinonyl group. Other suitable developing groups are an o-dihydroxyphenyl group, a o- and p-amino-substituted hydroxy group, and the like. In preferable dye developers, the dye structure moiety and the developing group are separated from each other by a saturated aliphatic group such as an ethylene group which prevents electronic conjugation. In particular, a 2-hydroquinonylethyl group and a 2-hydroquinonylpropyl group are useful. The dye structure moiety and the developing group can be connected to each other through a co-ordinate bond as described in U.S. Pat. Nos. 3,551,406, 3,563,739, 3,597,200 and 3,674,478, as well as a covalent bond. Furthermore, in some end-use purposes and in some structures of diffusion transfer color photographic materials, it is advantageous to reduce the dye structure moiety to thereby temporarily convert it to a colorless leuco form as described in U.S. Pat. No. 3,320,063, or to acylate the hydroxy group or amino group of the auxochrome to thereby temporarily shift the absorption to the shorter wavelength side as described in U.S. Pat. Nos. 3,230,085 and 3,307,947. Dye developers having a dye structure moiety containing a hydroxy group at the ortho position to the azo bond are useful in that they have excellent absorption characteristics and color image stability as described in U.S. Pat. No. 3,299,041. Other dye developers suitable for use in diffusion transfer color photography are described in U.S. Pat. Nos. 2,983,605, 2,992,106, 3,047,386, 3,076,808, 3,076,820, 3,077,402, 3,126,280, 3,131,061, 3,134,762, 3,134,765, 3,135,604, 3,136,605, 3,135,606, 3,135,734, 3,141,772, 3,142,565, 3,173,906, 3,183,090, 3,246,985, 3,230,086, 3,309,199, 3,230,083, 3,239,339, 3,347,672, 3,347,673, 3,245,790, 3,230.082, etc.

Specific examples of the dye developers suitable for use in diffusion transfer color photographic materials include the following dye developers 4-[p-(β-Hydroquinonylethyl)phenylazo]-3-(N-n-hexylcarbamoyl)-1-phenyl-5-pyrazolone 2-[p-(β-Hydroquinonylethyl)phenylazo]-4-isopropoxy-1-naphthol 1,4-bis-[β-(Hydroquinonyl-α-methyl)-ethylamino]-5,8-dihydroxyanthraquinone

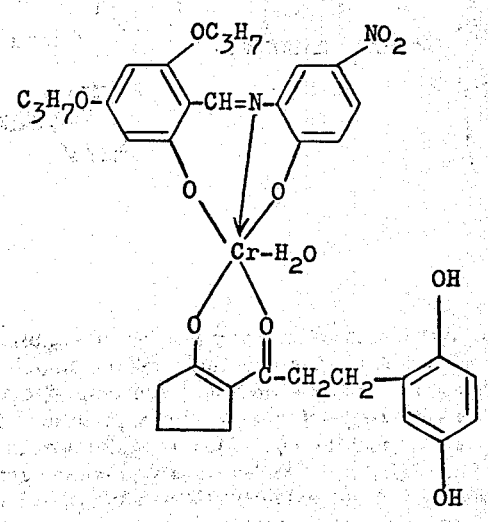

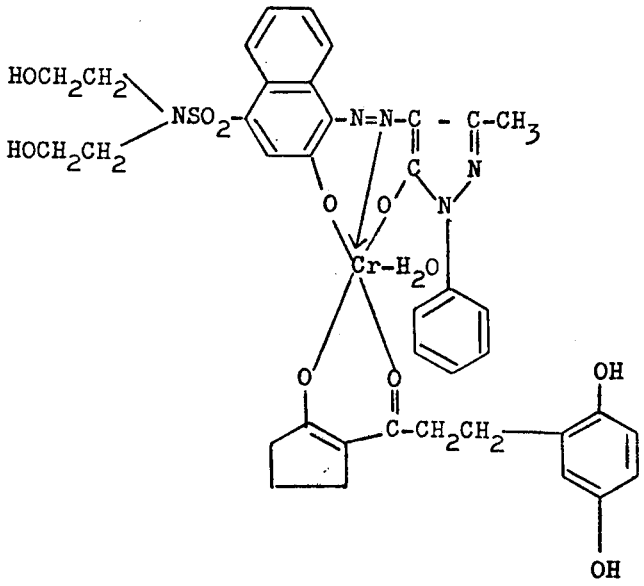

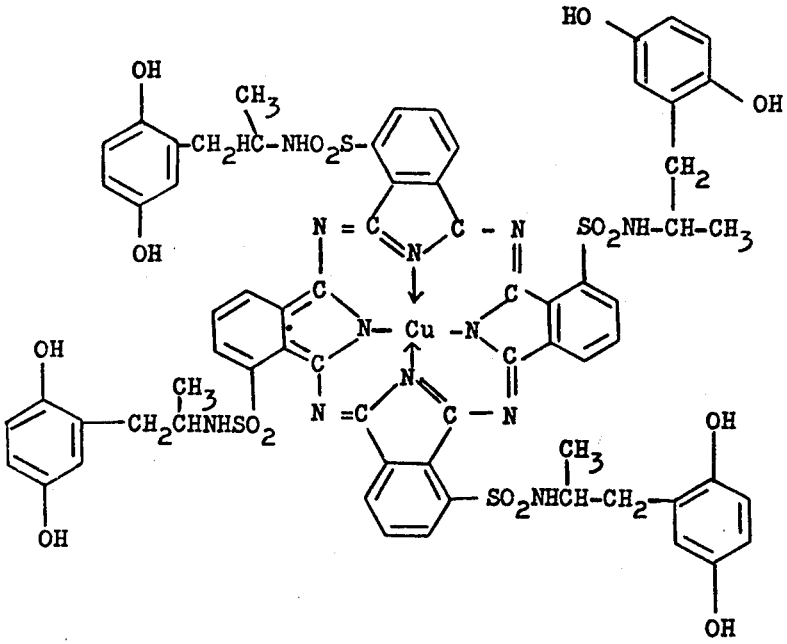

In diffusion transfer color photography using a dye developer as the dye image-forming material, it is advantageous to use an auxiliary developing agent to accelerate the development. For this purpose, developing agents such as 1-phenyl-3-pyrazolidone described in U.S. Pat. No. 3,039,869, hydroquinone derivatives such as 4'-methylphenylhydroquinone, t-butylhydroquinone, etc., or catechol derivatives described in U.S. Pat. No. 3,617,277 can be incorporated in a liquid processing composition or in a light-sensitive element, in particular, in a silver halide emulsion layer, a dye developer-containing layer, an interlayer or in a top-coating protective layer. Furthermore, in order to accelerate the development and the diffusion transfer, the processing can be conducted in the presence of an onium compound such as N-benzyl-α-picolinium bromide as described in U.S. Pat. No. 3,173,786.

b. Diffusible dye-releasing couplers;

A dye-releasing coupler is a reactive, non-diffusing compound capable of coupling with the oxidation product of the developing agent and, as a result of the coupling reaction, is capable of eliminating and releasing a dye which is soluble and diffusible in the development-processing composition. One type of diffusible dye-releasing coupler contains a structure in which the coupling reaction site is substituted with a residue which is eliminated by the oxidized developing agent. The electron conjugation system of the dye to be released can be either intially incorporated in the coupler or formed by the coupling reaction. The former is called the "pre-formed type". Couplers of this type show approximately the same spectral absorption as that of the dyes released. On the other hand, the latter is called the "instantly formed type". Couplers of this type are colorless in principle and, if colored, their absorptions have no relation to the absorption of the dye released and are temporary.

Typical diffusible dye-releasing couplers are represented by the following general formulae;

| | |
|---|---|
| (1) (Cp-1)-L-(Fr) | ("pre-formed type") and |
| (2) (Cp-2)-L-(Bl) | ("instantly formed type") |

wherein Cp-1 represents a coupling reaction-active structure in which the coupling position is substituted with a (Fr)-L-residue and at least one non-coupling position is substituted with a group containing a hydrophobic group having 8 or more carbon atoms and being capable of providing diffusion resistance or a ballasting property to the coupler molecule, Cp-2 represents a coupling reaction-active structure in which the coupling position is substituted with a (Bl)-L- residue and, When the coupler is used in combination with a developing agent which does not contain a water-solubilizing group, the Cp-2 group has a water-solubilizing group in at least one non-coupling position, and (Fr)-L- and (Bl)-L- represent groups which are eliminated by the oxidized developing agent wherein Fr represents a dye structure moiety having absorption in the visible wavelength region and having at least one water-solubilizing group and Bl represents a group containing a hydrophobic group having 8 or more carbon atoms and rendering the coupler molecule diffusion resistant.

As the coupling reaction-reactive structure moieties to be utilized as Cp-1 and Cp-2, there are many functional groups which are known to undergo an oxidative coupling reaction with an aromatic primary amine color developing agent. Examples include phenols, anilines, cyclic or open-chain active methylene compounds and hydrazones. Specific examples of particularly useful reactive structure moieties include those derived from acylamino-substituted phenols, 1-hydroxy-2-naphthoic acid amides, N,N-dialkylanilines, the 1-aryl-5-pyrazolones (with the 3-position being substituted with an alkyl group, an aryl group, an alkoxy group, an aryloxy group, an amino group, an acylamino group, ureido group or a sulfonamido group), the pyrazolobenzimidazoles, the pyrazolotriazoles, the α-cyanoacetophenones and the α-acylacetanilides.

As the connecting or linkage group L whose bond to the coupler structure moiety is split by the oxidized developing agent, an azo group, an azoxy group, a mercuryl group (—Hg—), an oxy group, a thio group, a dithio group, a triazolyl group, a diacylamino group, an acylsulfonamino group

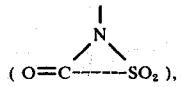

an acyloxy group, a sulfonyloxy group and an alkylidene group are illustrative. Of these, an oxy group, a thio group, a dithio group, a diacylamino group, an acyloxy group, etc., which are eliminated as an anion, are useful since the amount of the diffusible dyes released is great. The coupling position of the coupling structure of a phenol or naphthol is preferably substituted with the group connected through an oxy group, a thio group or a diacyloxy group. Also, the coupling position of a pyrazolone is preferably substituted with an azo group, a thio group or an acyloxy group, and the coupling position of an acylacetanilide with an oxy group, a thio group or a diacylamino group.

As representative examples of the dye structure moiety for Fr, there are illustrated the residues derived from azo dyes, azomethine dyes, indoaniline dyes, indophenol dyes, anthraquinone dyes, nitro dyes, azine dyes, etc.

The hydrophobic residues contained in the residues represented by Cp-1 and Bl impart a cohesive force between the coupler molecules in an aqeuous medium and make the molecule non-diffusible in a hydrophilic colloid forming the light-sensitive material. As hydrophobic residues, a substituted or unsubstituted alkyl group, an alkenyl group, an aralkyl group and an alkylaryl group, having 8 or more carbon atoms can be advantageously used. Examples of such groups are a lauryl group, a stearyl group, an oleyl group, a 3-n-pentadecylphenyl group, a 2,4-di-t-amylphenoxy group, and the like. These hydrophobic residues are connected, directly or through a divalent bond such as amino bond, an ureido bond, an ether bond, an ester bond or a sulfonamido bond, to a fundamental coupling structure to form Cp-1. Also, these hydrophobic residues form, themselves or together with an aryl group, a heterocyclic group or a like residue connected thereto directly or through the above-described divalent bond, the Bl group.

The water-solubilizing group contained in the residue represented by Cp-1 or Fr is an acidic group capable of being substantially dissociated in a processing solution or is a precursor which provides such an acidic group upon hydrolysis. In particular, acidic groups having a pKa of not more than about 11 are useful. Examples of such groups are a sulfo group, a sulfuric ester group (—O—$SO_3H$), a carboxy group, a sulfonamido group, a diacylamino group, a cyanosulfonamino group, a phenolic hydroxy group, etc.

The diffusible dye-releasing couplers represented by the general formula (1) undergo, upon reaction with an oxidized developing agent, cleavage of the L bond to form a non-diffusible condensate between CP-1 and the developing agent and a soluble dye containing the Fr structure moiety. This soluble dye diffuses into the image-receiving layer to form the dye images.

Diffusible dye-releasing couplers represented by the general formula (2) undergo, upon reaction with an oxidized developing agent, cleavage of the L bond to form a soluble dye which is an oxidative coupling reaction product betwween Cp-2 and the developing agent, and a non-diffusible, eliminated product derived from Bl. This soluble dye diffuses into the image-receiving layer to form the dye images.

Specific examples of diffusible dye-releasing couplers of the type represented by the structural formula (1) includes the following.

α-[4-(8-Acetamido-3,6-disulfo-1-hydroxy-2-naphthylazo)-phenyl]-α-pivalyl-4-(N-methyl-N-octadecylsulfamyl)acetanilide Disodium Salt 1-(p-t-Butylphenoxyphenyl)-3-[α-4-t-butylphenoxy)-propionamido]-4-(2-bromo-4-methylamino-5-sulfo-1-anthra-9,10-quinalylazo)-5-pyrazolone 1-Hydroxy-4-[3- 4-(N-ethyl-N-β-sulfoethylamino)-2-methylphenylazo phenylazo]-N-[8-(2,4-di-t-amylphenoxy)butyl]-2-naphthamide Sodium Salt Specific examples of diffusible dye-releasing couplers of the type represented by the structural formula (2) are as follows.

α-(4-Methoxybenzoyl)-α-(3-octadecylcarbamylphenylthio)-3,5-dicarboxyacetanilide

α-Pivalyl-α-(3-octadecylcarbamylphenylthio)-4-sulfoacetanilide Potassium Salt

1-Phenyl-3-(3,5-dicarboxyanilino)-4-(3- octadecylcarbamylphenylthio)-5-pyrazolone 1-Phenyl-3-(3,5-disulfobenzoylamino)-5-(2-hydroxy-4-n-pentadecylphenylazo)-5-pyrazolone 1-[4-(3,5-Dicarboxybenzamido)phenyl]-3-ethoxy-4-(3-octadecylcarbamylthio)-5-pyrazolone 1-Hydroxy-4-(3-octadecylcarbamylphenylthio)-N-ethyl-3′,5′-dicarboxy-2-naphthanilide, 1-Hydroxy-4-(n-octadecylsuccinimido)-N-ethyl-3′,-5′-dicarboxy-2-naphthanilide Other specific examples of diffusible dye-releasing couplers and the synthesis thereof are described in British Pat. Nos. 840,731, 904,364, 1,085,631, U.S. Pat. Nos. 3,476,563, 3,644,498, 3,419,391.

In the second type of diffusible dye-releasing couplers, the dye residue contained in the substituent in the position adjacent to the coupling reaction is split and released upon an intramolecular ring-closing reaction with the substituent which occurs subsequent to the condensation reaction with the oxidized developing agent. In particular, the reaction in which an aromatic amine developing agent is oxidatively coupled to the 4-position of phenol or aniline and then forms an azine ring together with a sulfonamido group in the 3-position containing the dye structure moiety to release a diffusible dye having a sulfonic acid group is useful.

Specific examples of this type of coupler include the following.

1-Phenyl-3-ethylcarbamoyl-4- 2-methoxy-4-[N-n-dodecyl-N-(1-hydroxy-4-chloro-3-naphthyl)]sulfamylphenylazo -5-pyrazolone 2-(β-Octadecylcarbamoylethyl)-4- 2-[4-(2-hydroxy-1-naphthylazo)phenylsulfonamido]-anilinophenol, and the like.

Examples of aromatic primary amino developing agents which can be advantageously used in combination with the diffusible dyereleasing couplers are p-aminophenol, p-phenylenediamine and derivatives thereof. In particular, 2-chloro-4-aminophenol, 2,5-dibromo-4-aminophenol, 4-amino-N,N-diethyl-3-methylaniline, N,N-diethyl-p-phenylenediamine, N-ethyl-β-methanesulfonamidoethyl-3-methyl-4-aminoailine, 4-amino-N-ethyl-N-(δ-sulfobutyl)-aniline, 4-amino-N-ethyl-N-(β-hydroxyethyl)aniline, 4-amino-3-methyl-N-ethyl-N-(β-hydroxyethyl)aniline, 4-amino-N-ethyl-N-(β-carboxyethyl)aniline, 4-amino-N,N-bis(β-hydroxyethyl)-3-methylaniline, 3-acetamido-4-amino-N,N-(β-hydroxyethyl)aniline, 4-amino-N-ethyl-N*(2,3-dihydroxypropyl)-3-methylaniline, 4-amino-N,N-diethyl-3-(3-hydroxypropoxy)aniline, 4-amino-N-ethyl-N-(β-hydroxyethyl)3-methoxyaniline, and the salts of these anilines such as the hydrochloride, sulfate, oxalate, p-toluenesulfonate, etc. salts are useful. Furthermore, precursors of these developing agents, such as the Schiff bases of these anilines and phthalimides are useful since they can be added to a light-sensitive element.

Negative silver halide emulsion layers containing the diffusible dye-releasing couplers provide negative diffusion transfer dye images upon development processing. On the other hand, direct positive silver halide emulsion layers containing the diffusible dye-releasing couplers provide positive diffusion transfer dye images. As direct positive emulsions, intermal latent image-type emulsions described in U.S. Pat. Nos. 2,592,250, 2,588,982, 3,227,552, etc. and fogged emulsions described in British Pat. No. 443,245, 462,730, U.S. Pat. Nos. 2,005,837, 2,541,472, 3,367,778, etc. are useful.

Positive diffusion transfer dye images can be obtained by processing a layer, which is provided adjacent the negative silver halide emulsion layer and contains the diffusible dye-releasing coupler and physical development nuclei, with a developer containing a solvent for silver halide. Techniques for forming reversal dye images utilizing physical development, such as those described in British Pat. No. 904,364 can be employed. Furthermore, light-sensitive elements containing, adjacent a negative silver halide emulsion layer containing a compound (DIR compound) which releases a development inhibitor such as 1-phenyl-5-mercaptotetrazole upon reaction with an oxidation product of a developing agent, a layer containing a diffusible dye-releasing coupler and a spontaneously reducible metal salt provide positive diffusion transfer dye images as described in U.S. Pat. Nos. 3,227,551, 3,227,554, 3,364,022, and German Pat. OLS No. 2,032,711. In the present invention, combination of these emulsions and the dye image-forming material can be employed, and suitable systems providing negative and positive dye images can be selected depending upon the end use purpose.

c. Diffusible dye-releasing reducing agents;

In the present invention, in addition to the aforesaid dye developers and diffusible dye-releasing couplers, a dye image-forming material which, after oxidation during development, releases a diffusible dye upon intramolecular reaction or reaction with an auxiliary agent contained in the solution can be advantageously used. In this type of dye image formation, it is advantageous to oxidize the dye image-forming material using an auxiliary developing agent such as a hydroquinone, a 3-pyrazolidone, etc. The oxidized dye image-forming material releases the diffusible dye due to the action of a supplementary agent such as hydrogen ion, sulfite ion, etc. present in a processing composition or in a light-sensitive element. Specific examples of this type of dye image-forming agents are described in U.S. Pat. Nos. 3,585,026, 3,698,897 and German Pat. OLS No. 2,242,762.

The dye image-forming material used in the present invention can be dispersed in a carrier, a hydrophilic colloid, using various methods depending upon the type of the dye image-forming material. For example, diffusible dye-releasing couplers or like compounds having a dissociable group such as a sulfo group or a carboxy group can be added to a hydrophilic colloid solution after being dissolved in water or alkaline aqueous solution. With dye image-forming materials which are slightly soluble in an aqueous medium and readily soluble in an organic solvent, they are first dissolved in an organic solvent, and then the resulting solution is added to a hydrophilic colloid solution, followed by stirring or the like to disperse the solution as fine particles. Suitable solvents are ethyl acetate, tetrahydrofuran, methyl ethyl ketone, cyclohexanone, β-butoxy-β-ethoxyethyl acetate, dimethyl-formamide, dimethylsulfoxide, 2-methoxyethanol, tri-n-butylphthalate, etc. Of these dispersion solvents, those which possess a comparatively low vapor pressure can be vaporized upon drying the photographic layers, or can be vaporized according to the method described in U.S. Pat. Nos. 2,322,027 and 2,801,171 prior to coating. Of these dispersion solvents, those which are readily soluble in water can be removed by washing with water according to the method of U.S. Pat. Nos. 2,949,360 and 3,396,027.

In order to stabilize the dispersion of the dye image-forming material and accelerate the dye image-forming step, it is advantageous to incorporate, in a light-sensitive element, a solvent which is substantially insoluble in water and has a boiling point of not less than about 200° C at an ordinary pressure together with the image-forming material. Examples of high boiling solvents suitable for this purpose are fatty acid esters such as the triglycerides of higher fatty acids and dioctyl adipate; phthalic esters such as di-n-butyl phthalate; phosphoric esters such as tri-o-cresyl phosphate and tri-n-hexyl phosphate; amides such as N,N-diethyl-laurylamide; hydroxy compounds such as 2,4-di-n-amylphenol; and the like. Furthermore, in order to stabilize the dispersion of the dye image-forming material and to accelerate the dye image formation step, it is advantageous to incorporate in a light-sensitive element a polymer having affinity for the solvent together with the dye image-forming material. Polymers having affinity for the solvent and suitable for this purpose are shellac, phenol-formaldehyde condensates, poly-n-butyl acrylate, n-butyl acrylate-acrylic acid copolymers, n-butyl acrylate-styrenemethacrylamide copolymers, and the like. These polymers can be dissolved in an organic solution together with the dye image-forming material and then dispersed in a hydrophilic colloid, or can be added, as a hydrosol prepared by emulsion polymerization or the like, to a hydrophilic colloid dispersion of the dye image-forming material.

In general, the dispersion of the dye image-forming material can be effectively conducted under great shearing force. For example, a high speed rotary mixer, a colloid mill, a high pressure milk homogenizer, a high pressure homogenizer as described in British Pat. No. 1,304,206, an ultrasonic emulsifying apparatus, and the like are useful. The use of surface active agents as an emulsifying aid markedly serves to disperse the dye image-forming material. Surface active agents useful for the dispersion of the dye image-forming material used in the present invention are sodium triisopropylnaphthalenesulfonate, sodium dinonylnaphthalenesulfonate, sodium p-dodecylbenzenesulfonate, dioctyl sulfosuccinate sodium salt, cetyl sulfate sodium salt and the anionic surface active agents described in Japanese Patent Publication No. 4293/64. The combined use of these anionic surface active agents and higher fatty acid esters of anhydrohexitol gives rise to a particularly good emulsifying ability as described in U.S. Pat. No. 3,676,141.

The silver halide emulsion used in the present invention is a colloidal dispersion of silver chloride, silver bromide, silver chlorobromide, silver bromoiodide, silver chlorobromoiodide, silver iodide or a mixture thereof. The halide composition is selected depending upon the end-use purpose of the light-sensitive material and the processing conditions. In particular, a silver bromoiodide emulsion or silver chlorobromoiodide emulsion containing about 1 mol% to 10 mol% iodide and not more than about 30 mol% chloride and the balance bromide is desirable. Useful silver halide grains have an average grain size of about 0.1 μ to about 2 μ. For some use purposes of the light-sensitive material, silver halides having a uniform grain size are preferable. The grains can take a cubic form, an octahedral form or a mixed crystal form. These silver halide emulsions can be prepared using conventional processes as described in P. Glafkides; *Chimie Photographique*, 2nd Ed., Chapters 18 to 23, Paul Montel, Paris (1957). That is, a soluble silver salt such as silver nitrate and a water-soluble halide such as potassium bromide are reacted with each other in the presence of a solution of a protective colloid such as gelatin and crystals are allowed to develop in the presence of excess silver halide or a solvent for silver halide such as ammonia. As precipitating methods, a single or double jet method or a pAg-controlled double jet method can be employed. Removal of the soluble salts from the emulsion can be achieved by washing, dialysis of the cool-set emulsion, by the combination of the addition of a sedimenting agent such as an anionic polymer containing sulfone groups, sulfuric acid ester groups or carboxy groups or an anionic surface active agent and the adjustment of pH, or by the combination of the use of an acylated protein such as phthaloylated gelatin as a protective colloid and the adjustment of pH, to thereby cause sedimentation.

The silver halide emulsions which can be used in the present invention are preferably subjected to chemical sensitization by heat-treatment using a sensitizer such as the natural sensitizers contained in gelatin, a sulfur sensitizer (e.g., sodium thiosulfate, N,N,N'-trimethylthiourea, etc.) as described in U.S. Pat. Nos. 1,574,944, 1,623,499, 2,410,689, etc., a gold sensitizer (e.g., a thiocyanate complex salt or thiosulfate complex salt of monovalent gold, etc.) or a salt of a noble metal such as palladium, ruthenium, rhodium, platinum, etc., as described in U.S. Pat. Nos. 2,448,060, 2,399,083, 2,642,361, etc., or a reducing sensitizer (e.g., stannous chloride as described in U.S. Pat. No. 2,487,850 or hexamethylenetetramine). Also, emulsions which tend to form latent images on the surface of the silver grains and emulsions which tend to form latent images inside the silver halide grains as described in U.S. Pat. Nos. 2,592,550, 3,206,313, etc. can be used in the present invention.

The silver halide emulsions which can be used in the present invention can be stabilized using additives such as 4-hydroxy-6-methyl-1,3,3a-7-tetrazaindene, 5-nitrobenzimidazole, 1-phenyl-5-mercaptotetrazole, 8-chloromercuriquinoline, benzenesulfinic acid, pyrocatechin, etc. In addition, inorganic compounds such as cadmium salts, mercury salts, complex salts of the platinum group metals such as the chlorocomplex salt of palladium, and the like are also useful for the stabilization of the light-sensitive material of the present invention. Examples of such stabilizers are disclosed in U.S. Pat. Nos. 2,806,437, 2,444,605, 2,403,927, 3,266,877, 3,397,987, etc. Furthermore, the silver halide emulsions which can be used in the present invention can contain sensitizing compounds such as a polyethylene oxide compound.

The silver halide emulsions used in the present invention can possess, if desired, a light sensitivity enlarged by optical sensitizing dyes. Useful optical sensitizing dyes are the cyanines, merocyanines, holopolar cyanines, styryls, hemicyanines, oxanols, hemioxanols, and the like. Specific examples of optical sensitizing agents are described in P. Glafkides, ibid, Chapters 35 to 41, and M. Hamer; *The Cyanine Dyes and Related Compounds* (*Interscience*) and in U.S. Pat. Nos. 2,519,001, 2,666,761, 2,734,900, 2,739,964, 3,481,742, 3,672,898, etc. In particular, cyanines in which a nuclear nitrogen atom is substituted with an aliphatic group containing a hydroxy group, a carboxy group or a sulfo group, such as those described in U.S. Pat. Nos. 2,503,776, 3,459,553 and 3,177,210 are especially useful in the practice of the present invention.

The processing composition permeable layers used in the invention such as the silver halide emulsion layer used in the invention, the dye image-forming material-containing layer and the auxiliary layers (e.g., a protective layer, an interlayer, etc.) contain a hydrophilic polymer as a binder. Suitable polymers are gelatin, casein, gelatin modified with an acylating agent or the like, vinyl polymer-grafted gelatin, proteins such as albumin, cellulose derivatives such as hydroxy-ethyl cellulose, methyl cellulose, carboxymethyl cellulose, etc., polyvinyl alcohol, the partially hydrolyzed products of polyvinyl acetate, polyvinyl pyrrolidone, high molecular weight non-electrolytes such as polyacrylamide, polyacrylic acid, the partially hydrolyzed products of polyacrylamide, anionic synthetic polymers such as vinyl methyl ether-maleic acid copolymers, N-vinylimidazoleacrylic acid-acrylamide copolymers, synthetic polymer amphoteric electrolytes such as polyacrylamide subjected to the Hofman reaction. These hydrophilic polymers can be used alone or in combination. Furthermore, these hydrophilic polymer layers can contain a latex-like polymer dispersion of hydrophobic monomers such as the alkyl acrylates, alkyl methacrylates, etc. These polymers, particularly, polymers having functional groups such as an amino group, a hydroxy group or a carboxy group can be made insoluble using various cross linking agents without loss of the processing composition permeability. Particularly useful cross linking agents include aldehyde compounds such as formaldehyde, glyoxal, glutaraldehyde, succinaldehyde, mucochloric acid, 2,3-dihydroxy-1,4-dioxane, dimethylol urea, acrolein oligomer, etc.; aziridine compounds such as triethylenephosphamide described in Japanese Patent Publication No. 8790/62; epoxy compounds such as bis-(2,3-epoxypropyl)methylpropyl ammonium paratoluene sulfonate, 1,4-bis-(2',3'-epoxypropyloxy)butane, 1,3-diglycidyl-5-($\gamma$-acetoxy-$\beta$-oxypropyl)isocyanurate, 1,4-bis(2',3'-epoxypropoxy)diethyl ether (described in Japanese Patent Publication No. 7133/59), etc.; active halogen compounds such as 2,4-dichloro-6-oxytriazine sodium salt, 2,4-dichloro-6-methoxytriazine, 2-hydroxy-4,6-dichloro-s-triazine sodium salt, sebacic acid bischloromethyl ester, N,N'-bis($\alpha$-chloroethylcarbamyl)piperazine, etc.; active vinyl compounds such as divinylsulfone, hexahydro-1,3,5-triacryl-s-triazine methylene bismaleimide, 5-acetyl-1,3-diacryoyl-1,3,5-hexahydrotriazine, N,N',N'-triacryloyl-1,3,5-hexahydro-triazine, etc.; methylol compounds such as N-polymethylolcarbon, hexamethylol melamine, etc.; ethyleneiminic compounds such as 2,4,6-triethyleneimino-1,3,5-triazine, bis-$\beta$-ethylene-iminoethyl thioether, etc.; methane sulfonate compounds such as 1,2-di(methanesulfonyloxy)ethane, 1,4-di(methanesulfonyloxy)-butane, 1,5-di(methanesulfonyloxy)-pentane, etc.; high molecular weight compounds such as dialdehyde starch, 3-hydroxy-5-chloro-s-triazinyl gelatin, etc. Suitable examples of such compounds are described in U.S. Pat. Nos. 3,232,764, 3,288,775, 2,732,303, 3,635,718, 3,232,763, 2,732,316, 2,586,168, 3,103,437, 3,017,280, 2,783,611, 2,725,294, 2,725,295, 3,100,704, 2,091,537, 3,321,313, etc. These hydrophilic polymer can contain a cross linking-accelerating agent such as a carbonate or resorcin as well as the cross linking agent.

The photographic layers used in the present invention can be coated using various coating methods such as a dip coating method, a roller coating method, an air knife coating method, a bead coating method as described in U.S. Pat. No. 2,681,294, a curtain coating method as described in U.S. Pat. Nos. 3,508,947 and 3,513,017. In particular, with the light-sensitive elements of a multi-layered structure, it is convenient to coat multi layers at the same time using a multi-slit hopper as described in U.S. Pats. Nos. 2,761,417, 2,761,418, 2,761,419, and 2,761,791.

In order to facilitate the coating of the photographic layers in the present invention, the coating composition can advantageously contain a variety of surface active agents as coating aids. Illustrative useful coating aids are nonionic surface active agents such as saponin, p-nonylphenol ethylene oxide adducts, the alkyl ethers of sugar, glycerin monoalkyl ethers, etc., anionic surface active agents such as sodium dodecylsulfate, sodium p-dodecylbenzenesulfonate, dioctylsulfosuccinate sodium salt, etc. and amphoteric surface active agents such as carboxymethyldimethyllauryl ammonium hydroxide inner salt, "Deriphat 151" produced by General Mills Inc., betaine compounds as described in U.S. Pat. No. 3,441,413, British Pat. No. 1,159,825 and Japanese Patent Publication No. 21985/71.

In order to facilitate the coating of the photographic layers used in the present invention, the coating composition can contain various thickening agents. For example, in addition to those which increase the viscosity of the coating composition due to their own viscosity such as high molecular weight polyacrylamide, anionic polymers such as cellulose sulfate, poly-p-sulfostyrene potassium salt and acrylic polymers as described in U.S. Pat. No. 3,655,407 which thicken the composition due to the mutual relationship with a binder polymer contained in the coating composition are similarly useful.

The processing composition used in the present invention is a liquid composition containing processing components necessary for the development of a silver halide emulsion and necessary for the formation of a diffusion transfer dye image. The main solvent therein is water and, in some cases, hydrophilic solvents such as methanol or methyl cellosolve can be additionally present. The processing composition contains alkali in a sufficient amount to maintain the pH at a level necessary for causing development of the emulsion layer or layers and to neutralize acids produced during various steps of development and dye image formation. As the alkali, sodium hydroxide, potassium hydroxide, a calcium hydroxide dispersion, tetramethylammonium hydroxide, sodium carbonate, trisodium phosphate, diethylamine, etc., can be used. The processing composition preferably possesses a pH of not less than about 12 at room temperature (about 20°–30° C). More preferably, the processing composition contains a hydrophilic polymer such as high molecular weight polyvinyl alcohol, hydroxyethyl cellulose, sodium salt of carboxymethyl cellulose or the like. These polymers impart a viscosity of not less than 1 poise, preferably about 1,000 poises, at room temperature, to the processing composition, which not only facilitates the uniform spreading of the composition upon processing but also forms, upon concentration of the processing solution due to the migration of the aqueous solvent into the light-sensitive element and into the image-receiving element in the course of the processing, an immovable film, thus serving to unify the film unit after processing. In addition, this polymer film can serve, after the substantial completion of the formation of the diffusion transfer dye image, to control further migration of the coloring ingredients into the image-receiving layer, thereby preventing the image from being changed.

In some cases, the processing composition advantageously contains a light absorbent such as carbon black and a desensitizer as described in U.S. Pat. No. 3,579,333 so as to prevent the silver halide emulsion from being fogged by light from the outside during processing. Furthermore, the processing composition contains processing ingredients specific to the dye image-forming material used. For instance, with a dye developer, auxiliary developing agents such as p-aminophenol, 4′-methylphenylhydroquinone, 1-phenyl-3-pyrazolidone, etc., an onium development accelerator such as N-benzyl-α-picolinium bromide, an antifogging agent such as benzotriazole are examples of such ingredients which can be used and with the diffusible dye-releasing couplers, developing agents such as an aromatic primary amino color developing agent, an anti-oxidizing agent such as a sulfite or ascorbic acid, an anti-fogging agent such as a halide or 5-nitro-benzimidazole, a silver halide solvent such as thiosulfate or uracil are examples of such ingredients which can be used.

The processing composition used in the present invention is advantageously retained in a rupturable container. Such a container is advantageously prepared by folding a sheet of a liquid- and air-impermeable substance and sealing each edge to form a cavity in which the processing composition is retained, and the container is advantageously formed so that, when the film unit passes through pressure-applying members, the container is ruptured at a given portion due to the inner hydraulic pressure generated within the processing composition container to thereby release the contents. As the substance for forming the container, a polyethylene terephthalate/polyvinylalcohol/polyethylene laminate, a lead foil/vinyl chloride-vinyl acetate copolymer laminate or the like can be advantageously used. This container is desirably fixedly positioned and extends transverse a leading edge of the film unit so that a substantially uni-directional discharge of the container's contents on the surface of the light-sensitive element is achieved. Preferred examples of such a container are described in U.S. Pat. No. 2,543,181, 2,643,886, 2,653,732, 2,723,051, 3,056,491, 3,056,492, 3,152,515, 3,173,580. These containers are advantageous in the practice of the present invention.

The image-receiving element used in the invention fixes the dye image-forming materials such as the diffusible dyes, etc., which are released in an imagewise distribution from a dye image-forming material associated with the silver halide emulsion. Where dye developers having a hydroquinonyl group or anionic substances such as coloring dyes having an acidic water-solubilizing group are used as the dye image-forming material, the image-receiving element preferably contains a basic polymer or a basic surface active agent. As the basic polymer, those polymers which contain tertiary or quaternary nitrogen atoms are excellent. More specifically, illustrative examples are poly-4-vinylpyridine, a polymer of the aminoguanidine derivative of vinyl methyl ketone as described in U.S. Pat. No. 2,822,156, poly-4-vinyl-N-benzylpyridinium p-toluenesulfonate, poly-3-vinyl-4-methyl-N-n-butylpyrdinium bromide, a styrene/N-(3-maleimidopropyl)-N,N-dimethyl-N-(4-phenylbenzylammonium chloride) copolymer as described in British Pat. No. 1,261,925, poly N-(2-methacryloylethyl)-N,N-dimethyl-N-benzylammonium chloride, etc. As the basic surface active agent, those surface active agents which possess an onium residue such as an ammonium, sulfonium or phosphonium residue and possess a hydrophobic residue such as a long-chain alkyl group are excellent. Specific examples are N-laurylpyridinium bromide, cetyltrimethylammonium bromide, methyl-tri-n-laurylammonium p-toluenesulfonate, methyl-ethyl-cetylsulfonium iodide, benzyltriphenylphosphonium chloride, etc. In addition to these basic compounds, multivalent metals such as thorium, aluminum, zirconium, etc. also exert a fixing action on the anionic dye image-forming materials. These substances advantageously form films together with polymers such as gelatin (in particular, acid-processed gelatin), polyvinyl alcohol, polyacrylamide, polyvinyl methyl ether, hydroxyethyl cellulose, N-methoxymethylpolyhexylmethyleneadipamide, polyvinyl pyrrolidone, etc.

Where the dye image-forming material is one component for forming a dye-like diffusible coupler, the image-receiving layer contains other coupling component capable of reacting with this component to form dye, such as a p-phenylenediamine derivative and an oxidizing agent, or a diazonium compound. As this type of image-receiving element, those described in U.S. Pat. Nos. 2,647,049, 2,661,293, 2,698,244, 2,698,798, 2,802,735, 3,676,124, British Pat. Nos. 1,158,440 and 1,157,507 can be used.

The film unit of the present invention can contain a developing agent scavenger which reacts with excess developing agent remaining after the processing to form a colorless product which is difficult to oxidize. In particular, a film unit which contains the above-described scavenger in an acidic substance-containing neutralizing layer, in a neutralization rate-adjusting layer or in a image-receiving layer of the unit provides distinct images with less stains. Film unit which contains an aromatic primary amino developing agent, tending to cause stain, advantageously contain as the scavenger a compound containing a functional group capable of condensing with amines, such as an isocyanate, an aldehyde precursor and a vinylsulfonyl compound described in German Patent OLS Nos. 2,201,392, 2,225,480, and 2,225,497.

The diffusion transfer photographic film unit of the present invention preferably possesses the function of neutralizing alkali brought thereinto from a processing composition. The processing composition contains alkali so as to provide a pH of higher than 10, preferably higher than 12, which is high enough to accelerate the image-forming steps comprising the development of the silver halide, the formation of the diffusible dye image-forming material and the diffusion. After the substantial completion of the formation of the diffusion transfer images, the pH in the film unit is reduced to around neutrality, less than 9, preferably less than 8, whereby further image-formation is actually discontinued to prevent the image tone from being changed with the lapse of time and to control discoloration and fading of the images and stain of the white background due to high alkalinity. For this purpose, it is advantageous to provide in the film unit a neutralizing layer containing an acidic substance in a sufficient quantity to neutralize the alkali contained in the processing composition to the above-described pH, that is, in an area concentration equivalent to or greater than the amount of the alkali contained in the spread processing composition. As preferable acidic substances, those which contain an acidic group of a pKa of less than 9, particularly a carboxy group or a sulfonic acid group, or contain a precursor group capable of providing such an acidic group upon hydrolysis can be employed. As more preferable examples, there are the higher fatty acids such as oleic acid described in U.S. Pat. No. 2,983,606, polymers of acrylic acid, methacrylic acid or maleic acid, the partially esterified polymers thereof, or acid anhydrides. Specific examples of high molecular weight acidic substances are copolymers of a vinyl monomer (e.g., ethylene, vinyl acetate, vinyl methyl ether, etc.) and maleic anhydride, and the n-butyl half ester thereof, copolymers of butyl acrylate and acrylic acid, cellulose acetate.hydrogen phthalate, and the like.

In addition to these acidic substances, the neutralizing layer can contain polymers such as cellulose nitrate and polyvinyl acetate, and a plasticizer as described in U.S. Pat. No. 3,557,237. Furthermore, the neutralizing layer can be hardened using the cross linking reaction with a multifunctional aziridine compound, epoxy compound, etc. The neutralizing layer is positioned in the image-receiving element and/or the light-sensitive element. In particular, it is advantageously positioned between the support of the image-receiving element and the image-receiving layer. As is described in German Patent OLS No. 2,038,254, the acidic substance can be microencapsulated for incorporation in the film unit.

The neutralizing layer or the acidic substance-containing layer used in the present invention is desirably separated from the spread processing composition layer by a neutralization rate-adjusting layer. This neutralization rate-adjusting layer functions to prevent an unfavourable reduction in the transfer image density due to a too fast reduction in the pH before the necessary development of silver halide emulsion layer and the formation of the diffusion transfer image are completed. That is, this layer functions to delay the reduction in the pH until the necessary development and transfer are completed. In a preferable embodiment of the present invention, the image-receiving element possesses a multi-layered structure comprising a support—a neutralizing layer—a neutralization rate-adjusting layer—a mordant layer (image-receiving layer) in this sequence. The neutralization rate-adjusting layer comprises mainly polymers such as gelatin, polyvinyl alcohol, polyvinyl propyl ether, polyacrylamide, hydroxypropylmethyl cellulose, isopropyl cellulose, partial butyrated polyvinyl alcohol, partially hydrolyzed polyvinyl acetate, a copolymer of $\beta$-hydroxyethyl methacrylate and ethyl acrylate, and the like. These polymers are usefully hardened through a cross linking reaction with an aldehyde compound such as formaldehyde or an N-methylol compound. The neutralization rate-adjusting layer has a thickness of preferably 2 $\mu$ to 20 $\mu$.

In the light-sensitive element used in the present invention, a dye image-forming material is associated with a silver halide emulsion. The combination of the color sensitivity of the silver halide emulsion and the spectral absorption of the dye image is appropriately selected depending upon the intended color reproduction. In the reproduction of natural colors according to subtractive color photography, a light-sensitive element having at least two combinations of emulsions having a selective spectral sensitivity in a certain wavelength region with compounds having a selective absorption in the same wavelength region is used. In particular, a light-sensitive element containing the combination of a blue-sensitive silver halide emulsion with a compound capable of forming a yellow dye image, the combination of a green-sensitive emulsion with a compound capable of forming a magenta dye image, and the combination of a red-sensitive emulsion with a compound capable of forming a cyan dye image is useful. In the light-sensitive element, these combination units of emulsions and dye image-forming materials are coated as layers in a face to face alignment or coated by forming each as particles and mixing. In a preferred multilayered structure for the film unit of the invention, there are positioned, in sequence from the side to be exposed, a blue-sensitive emulsion, a green-sensitive emulsion and a red-sensitive emulsion. In particular, in the case of high speed emulsions containing iodide, a yellow filter can be positioned between the blue-sensitive emulsion and the green-sensitive emulsion. This yellow filter contains a yellow colloidal silver dispersion, an oil-soluble yellow dye dispersion, an acidic dye mordanted with a basic polymer, or a basic dye mordanted with an acidic polymer. The emulsion layers are advantageously separated from each other by an interlayer. The interlayer prevents disadvantageous mutual action from occurring between the emulsion layer units of different color sensitivities. The interlayer comprises a polymer containing fine pores such as a latex of a hydrophilic polymer and a hydrophobic polymer, as described in U.S. Pat. No. 3,625,685 or a polymer whose hydrophilicity is gradually increased by the processing composition, such as calcium alginate, as described in U.S. Pat. No. 3,384,483, as well as a hydrophilic polymer such as gelatin, polyacrylamide, a partially hydrolyzed product of polyvinyl acetate, etc. The interlayer can contain an interlayer mutual action-controlling agent selected depending upon the type of the dye image-forming material and the processing solution used. For example, with a dye image-forming material of the type which releases a diffusible dye due to the action of the oxidation product of a developing agent, reducing agents such as ballasted hydroquinone derivatives and ballasted couplers capable of reacting with the oxidation product to be fixed are effective for preventing undesired interchange of the oxidation product of a developing agent between the emulsion units. Furthermore, in order to achieve good color reproduction, it is useful, in a system wherein image reversion is effected by dissolution and physical development, to further incorporate physical development nuclei such as metal silver colloid in the interlayer and, in a system wherein image reversion is effected using a development inhibitor-releasing (DIR) compound, it is useful to incorporate silver halide grains of a low sensitivity and of a fine size in the interlayer.

The support which can be used in the present invention is a planar substance which does not undergo any serious dimensional change due to the processing composition during the processing. For some purposes, rigid supports such as a glass plate can be used. However, in general, flexible supports are useful. As a flexible support, those supports for photographic light-sensitive materials, such as a cellulose nitrate film, a cellulose acetate film, a polyvinylacetal film, a polystyrene film, a polyethylene terephthalate film, a polycarbonate film, etc., can be advantageously used. A support having dimensional stability and oxygen-impermeability such as a laminate in which a polyvinyl alcohol layer is sandwiched between polyethylene terephthalate layers or cellulose acetate layers is particularly desirable since the laminate serves to provide stable dye images and suffers less stain.

In order to help the moisture contained in the spread processing composition evaporate through the support after the processing, it is advantageous to use an aqueous vapor permeable support, such as is described in U.S. Pat. No. 3,573,044. In order to prevent incident light leakage through the edges of the transparent support to the silver halide emulsion layer during the processing of the film unit in a bright place, the transparent support is desirably colored to such an extent that the transmission of light in a planar direction parallel to the support can be prevented without inhibiting imagewise exposure and observation therethrough. If desired, the support can contain a plasticizing agent such as a phosphoric ester, a phthalic ester, etc., an ultraviolet light-absorbing agent such as 2-(2-hydroxy-4-t-butylphenyl)benzotriazole, etc., an antioxidant such as a hindered phenol, etc. In order to maintain the adhesion between the support and the hydrophilic polymer-containing layer, it is advantageous to provide a subbing layer or to subject the surface of the support to a preliminary treatment such as a corona discharge, an irradiation with ultraviolet light or a flame treatment. The thickness of the support is usually about 20 to 300 microns.

In the present invention, the light-reflecting substance is used in order to form a white background of the dye image to be formed in the image-receiving layer. Suitable light-reflecting substances are titanium dioxide, barium sulfate, zinc oxide, aluminum oxide, barium stearate, calcium carbonate, silicon dioxide, zirconium oxide, kaolin, magnesium oxide, etc. These substances can be used alone or in combination. Such a light-reflecting substance can be either initially formed or, as is described in Belgian Pat. Nos. 768,110 and 768,111, formed in a given position from a precursor distributed in a film unit. The light-reflecting substance can be incorporated in the layer which contains a hydrophilic polymer such as polyvinyl alcohol, gelatin, hydroxypropyl cellulose, polyvinyl pyrrolidone, etc., as a binder. Furthermore, the substance can be compounded in the processing composition so that, upon spreading of the processing composition, the substance is fixed in a dispersed state in a layer of a film-forming polymer such as hydroxyethyl cellulose or carboxymethyl cellulose formed upon spreading of the solution. The combined use of the light-reflecting substance and a fluorescent brightening agent such as a stilbene, a coumarine, a triazine, an oxazole, etc. provides a beautiful white background. In order to protect a silver halide emulsion layer from ambient light during processing, it is advantageous to incorporate, as is described in Belgian Pat. Nos. 743,336, 768,107 and 768,109, a dye which takes a colored form at a pH higher than the pKa thereof and becomes colorless at the pH less than the pKa. The light-reflecting substance-containing layer advantageously possesses a light-reflecting substance/binder polymer composition ratio (by weight) of about 0.5 to about 100, and has a dry thickness of about 5 $\mu$ to 50 $\mu$. Also, the layer possesses a reflectivity of not less than about 50%, preferably not less than 70%.

The film unit of the present invention has a rupturable container retaining the processing composition. When compressed by pressure-applying members, this container is ruptured due to internal pressure to release the processing composition in a predetermined manner.

As the pressure-applying members, a variety of means can be used. In particular, means comprising at least one pair of members juxtaposed with a certain gap or clearance is suited for the processing of the film unit of the present invention. A pair of members are fixedly positioned with a certain clearance or oppose each other through a spring or like elastic body. The members may be idle rollers or motor-driven rollers. Upon passing between a pair of juxtaposed pressure-applying members, the container is ruptured, the processing composition is released and spread between the two elements in a layer form. Those juxtaposed pressure-applying members described in U.S. Pat. Nos. 3,647,441 and 3,652,281 can be advantageously used.

The film unit of the present invention has the following advantages.

1. An ordinary camera which does not contain an image-inverting system such as a mirror can be utilized.

2. In the film unit of the present invention, the light-sensitive element can be stored, before exposure, separate from the image-receiving element, light-intercepting element and the processing composition. Therefore, the sensitive light-sensitive element is hardly affected by the chemicals contained in the image-receiving element, the light-intercepting element and the processing composition.

3. In the film unit of the present invention in which the unit is completely unified in a camera, the image-receiving element, the light-intercepting element and, if desired, the processing solution container are unified. Thus the unifying operation can easily be effected with a smaller number of movable members.

4. Since the light-sensitive element and the image-receiving element/light-intercepting element composite are unified by friction in the direction of the element plane, the film unit of the invention requires only a small space for unifying the unit, which provides the ability to make a camera compact.

5. Unification of the film unit of the present invention which is to be effected in a camera can easily be mechanized.

6. The film unit of the invention enables a conventional camera for diffusion transfer photographic materials to be used, in which the image-receiving element is delaminated after processing, as such or with only a slight modification.

7. In the film unit of the invention, processing can be effected under almost closed conditions and the unit can be utilized without delamination after processing. Therefore, the possibility of contact with the alkaline processing solution by the user of the unit is small.

8. Since the processing solution is spread between the emulsion layer and the image-receiving layer in the film unit of the present invention, the direction in which the processing solution penetrates is reverse to the direction of diffusion of the transfer dye image-forming material in the light-sensitive element. Therefore, transferred dye images with good color separation can be obtained with ease.

9. In the film unit of the invention, the light-sensitive element possesses a transparent support independent of the image-receiving element. Therefore, the light-sensitive element can be separated, after transferring, without destroying the dye images and can be re-used as a transparent original for additional prints.

10. In the film unit of the present invention, a completed layer having sufficient light-intercepting ability can be used as the light-intercepting element, which ensures processing even under high illumination.

Other aspects of the present invention will become additionally apparent from the following detailed descriptions.

FIG. 1 illustrates a cross-sectional view of specific examples of the light-sensitive element, the image-receiving element and the processing composition container. FIG. 1 is drawn to show clearly the disposition of each constituent. Dimensions are not proportional and, in some cases, are greatly exagerated. Light-sensitive element 1 contains light-sensitive member 61 which comprises transparent support 51 having on the one side thereof, in sequence, yellow dye image-forming material-containing layer 52, blue-sensitive silver halide emulsion layer 53, yellow filter layer 54, magenta dye image-forming material-containing layer 55, green-sensitive silver halide emulsion layer 56, interlayer 57, cyan dye image-forming material-containing layer 58 and red-sensitive silver halide emulsion layer 59. Light-intercepting layer 60 containing a light absorbent is coated thereon and backing layer 50 is coated on the opposite side of the support. Image-receiving element 2 contains image-receiving member 74 which comprises transparent support 70 having thereon, in sequence, neutralizing layer 71 containing an acidic substance, neutralization rate-adjusting layer 72 and image-receiving layer 73. The main constituent of light-intercepting element 3 is a light absorbent-containing layer 81, and auxiliary layer 80 is applied to the inside surface thereof. This auxiliary layer functions to facilitate the introduction of the light-sensitive element and to accelerate the adhesion of the film unit unified after processing. The outer surface thereof is covered with white pigment-containing layer 82. Processing solution container 4 is a pod prepared from e.g., a laminate film of lead foil 92 and vinyl chloride-vinyl acetate copolymer layer 91, and retains processing solution 93. Upon application of pressure to the container, the seal 90 is ruptured due to the inner pressure of the processing composition to release the contents.

FIG. 2 illustrates the disposition wherein one film unit of the present invention is exposed in a camera. Light transmitted through lens 100 which focuses the image on light-sensitive element 1 to provide imagewise exposure. In this occasion, image-receiving element/light-intercepting element composite 6 is positioned under pressure plate with image-receiving element 2 directed toward the lens. Leader paper 5 is connected to one end of the light-sensitive element and enters the composite through opening 8 following a circuitious path around the pressure plate, and penetrates the composite through another opening. The composite is surrounded by binding member 7. On the other end of the light-sensitive element is provided excess solution reservoir 9. The rear end of this member also functions as a stopper which determines the degree of introduction of the light-sensitive element into the composite. In effecting the processing, leader paper is pulled while the composite is to stationary thereby position the light-sensitive element in composite 6 and, subsequently, the film unit is withdrawn from the camera through a pair of compressing rollers 102 to thereby rupture the processing solution container and spread the container contents.

FIG. 3 shows the same film unit during processing, as viewed from the surface side. A normal, non-inverted image is obtained.

FIG. 4 shows the back side of the film unit. Ruptured processing solution container 4' is viewed at the leading end. The leader paper is properly removed from the print.

FIG. 5 shows the disposition wherein another film unit of the present invention is exposed in a camera. This disposition is substantially the same as in FIG. 2. However, light-sensitive element 1 and image-receiving element/light-intercepting element composite 6 are not connected to each other through a leader paper or like member, but the corresponding relationship is ensured by an element-carrying apparatus 103 which is a part of the camera.

FIG. 6 shows the back side of the composite of this film unit, in which opening 8 for the introduction of the light-sensitive element is shown. After imagewise exposure, light-sensitive element 1 is carried by the element-carrying apparatus in a U-form until it is introduced through slit 104 and through the opening into composite 6. The thus unified film unit upon introduction is then withdrawn from the camera through a pair of pressure-applying rollers 102 to spread the processing solution.

FIG. 7 shows the surface of the film unit thus processed. Thus, a normal, non-inverted image is obtained.

FIG. 8 shows the back side thereof. The opening is closed by the extension of light-intercepting element 3, and ruptured processing solution containder 4' remains at the leading end.

FIG. 9 shows a cross-sectional view of the film unit illustrated in FIG. 2 and in the direction of proceeding to the pressure-applying members.

FIG. 10 shows the composite of the image-receiving element and light-intercepting element illustrated in FIG. 6 in direction of proceeding thereof. At the rear end of the light-intercepting element, a curved covering member is provided, which is intended to close the opening upon the passage of the composite through the pressure-applying rolls.

FIGS. 11 and 12 show vertical cross-sectional views of the processed film unit of the present invention in the direction of proceeding to the pressure-applying members. These figures show the situation in which binding member 7 positioned outside the elements and binding member 11 positioned between the elements adjust the spread processing solution layer 10 to a definite thickness. In the film unit based on the binding method as illustrated in FIG. 12, the light-intercepting element and the light-sensitive element can be delaminated, if desired, with ease from the back side. This configuration is useful where the processed light-sensitive element is to be re-used as a negative for color prints.

The present invention will now be illustrated in greater detail by reference to the following non-limiting examples of preferred embodiments of the present invention. Unless otherwise indicated, all parts, percents, ratios and the like are by weight.

EXAMPLE 1

(I) Light-intercepting elements were prepared as follows.

[Light-Intercepting Element A]

70 grams of carbon black (furnace type carbon black subjected to an oxidative surface treatment; mean particle size: 27 mμ) was added to 500 cc of an aqueous solution containing 1.0 g of sodium hydroxide, 3.5 g of 1-ethyl-2-heptadecylbenzenesulfonic acid sodium salt and 35 g of gelatin under stirring, and then the solution was passed through a colloid mill 5 times at 40 to 50° C. The resulting fine dispersion was adjusted to a pH of 5.8 with 2% acetic acid. This coating solution was coated on one side of a 75 μ-thick polyethylene terephthalate film containing 4.0% by weight carbon black (channel type carbon black; mean particle size: 13 mμ) in a dry thickness of 3.5 μ.

[Light-Intercepting Element B]

On one side of a 120 μ-thick cellulose triacetate film containing 2.5% by weight carbon black (channel type carbon black; mean particle size: 13 μ) and plasticized with triphenyl phosphate was provided a 3 μ-thick gelatin layer containing 1% by weight of perfluorobutyric sodium salt.

[Light-Intercepting Element C]

A carbon black-containing light-intercepting paper (85 g/m²; thickness: about 90 μ) for wrapping photographic materials.

[Light-Intercepting Element D]

On the one side of a 75 μ-thick sheet comprising 50 g of polyvinyl alcohol (saponification degree: 99%; mean molecular weight: about 200,000), 50 g of carbon black (furnace type carbon black subjected to an oxidative surface treatment; mean particle size: 27 mμ) and 0.5 g of ethylene glycol was coated an aqueous solution containing 50 g of polyvinyl alcohol (as described above) and 150 g of titanium dioxide in a dry thickness of 15 μ.

These light-intercepting elements were folded to prepare envelopes. A high speed panchromatic film (ASA 100; a silver iodobromide emulsion having a sensitivity in the range of 300 to 700 mu) inserted into each envelope and exposed for 5 minutes to 100,000 1x light emitted from a xenon lamp equipped with a water filter, followed by developing the films (26° C; 12 minutes; Kodak D-76). In every light-intercepting element, no detectable increase in fog of the film was observed. Thus, these light-intercepting elements were found to possess sufficient light-intercepting ability. In this case, Light-Intercepting Elements A and B were folded with the gelatin-containing layer directed inside, and Light-Intercepting Element D with the white layer directed outside.

(II) Image-receiving elements were prepared as follows.

[Image-Receiving Element M]

On a 80 μ-thick, transparent film base comprising polyethylene terephthalate were coated, in sequence, the following layers.

1. 100 grams of vinyl methyl ether-maleic anhydride copolymer (Gantrez AN-139; made by GAF; molar ratio 1:1, specific viscosity of 1.2 as a 1% methyl ethyl ketone) was dissolved in 400 ml of methyl ethyl ketone. Then, 1 ml of phosphoric acid (88%) and 38 g of n-butanol were gradually added thereto, and the system was maintained at about 75° C for 48 hours under stirring. Thereafter, 200 ml of acetone, 262 ml of ethyl acetate and 30 ml of an acetone solution containing 1.5 g of 1.4-bis(2′,3′-epoxypropoxy)butane as a cross linking agent were added thereto and coated in a dry thickness of 24 μ.

2. 50 grams of polyvinyl alcohol (saponification degree: 99%; mean molecular weight: about 200,000) was dissolved in 800 ml of water under heating. To this were added 0.4 g of polyethylene (20)sorbitan monooleate ("Tween 80", produced by Atlas), 1 g of tetramethylol urea and 10 ml of a 5% phosphoric acid solution, and coated in a dry thickness of 8 μ, followed by drying. Subsequently, the element was heated for 2 hours at 80° C and 75% R.H.

3. 50 grams of poly-4-vinylpyridine was dissolved in 300 ml of an aqueous solution containing 28 g of acetic acid. To this was added 425 g of an aqueous solution containing 25 g of polyvinyl alcohol. Then, 0.4 g of polyethyleneoxy (20) sorbitan monoleate and 0.5 g of tetramethylol urea were added thereto, and coated in a dry thickness of 8 μ.

[Image-Receiving Element N]

On a 60 μ-thick, transparent cellulose acetate film base containing triphenyl phosphate and dimethoxyethyl phthalate as plasticizers were coated, in sequence, the following 4 layers to prepare an image-receiving element.

1. A 30 μ-thick layer comprising 100 parts by weight of polyvinyl alcohol (saponification degree: 99%; highly viscous product; "Evanol 72-60" made by du Pont) and 3 parts by weight of hexamethylol melamine.

2. A neutralizing layer formed by dissolving 100 g of a vinyl acetatemaleic anhydride copolymer (molar polymerization ratio: 1:1; approximate molecular weight: about 300,000) in 400 ml of methyl ethyl ketone, gradually adding thereto 0.5 ml of phosphoric acid (88%) and then 40 g of n-lauryl alcohol, maintaining the system at about 75° C for 72 hours under stirring and, after cooling, adding thereto 250 ml of acetone, 30 ml of an acetone solution containing 1.5 g of 1,4-bis(2′,3′-epoxy-propoxy)-butane and a hot solution containing 7 g of hexahydro-1,3,5-triacryloyl-s-triazine in 50 ml of cyclohexanone, then coating the resulting mixture in a dry thickness of 25 μ.

3. A 10 μ-thick layer of high molecular weight polyvinyl acetate (saponification degree: 50%).

4. 8 μ-thick layer comprising 2 parts by weight of acid-processed gelatin, 1 part by weight of poly N-(2-methacryloylethyl)N,N,N-trimethylammonium p-toluenesulfonate, 0.01 part by weight of polyethyleneoxy (20) sorbitan monoleate and 0.02 part by weight of hexamethylolmelamine.

III. Assembly of a composite of an image-receiving element and a light-intercepting element;

The above-described image-receiving element was cut into a 110 × 90 mm rectangle, and a 20 × 90 mm container retaining 1 $cm^3$ of a processing solution was adhered to the surface of the image-receiving layer along the shorter edge (at the leading end). Then, thin pieces of cellulose triacetate (2 mm × 90 mm × 240 μ) were fixedly positioned as a spacer along both of the remaining longer edges.

The above-described light-intercepting element, cut into a 90 × 90 mm square form, was superposed thereon, with only the portions corresponding to the spacers being adhered thereto.

Fixation of the spacers was effected by heat adhesion using polyvinyl acetate. Then, both side edges were wrapped with a white, pressure-sensitive tape of a thickness of 80 μ to bind them. Light-Intercepting Elements A and B were assembled with the gelatin layer directed inside, and Light-Intercepting Sheet D was assembled with the white layer directed outside. Thus, composites corresponding to those illustrated in the accompanying FIGS. 1, 9 and 11 were prepared.

As the processing solution the following Processing Solutions P and Q were used, respectively, for Image-Receiving Sheet M and Image-Receiving sheet N.

[Processing Solution P]

| | | |
|---|---|---|
| Water | 100 | ml |
| Calcium Hydroxide | 12.0 | g |
| Carboxymethyl Cellulose | 3.5 | g |
| N-Benzyl-α-picolinium Bromide | 1.5 | g |
| Benzotriazole | 1.0 | g |
| Titanium Dioxide (rutile type) | 50.0 | g |

[Processing Solution Q]

| | | |
|---|---|---|
| Water | 100 | ml |
| Ascorbic Acid | 20 | ml |
| N-Ethyl-N-(β-hydroxyethyl)-p-phenylenediaminesulfate Monohydrate | 3.3 | g |
| Potassium Bromide | 150 | mg |
| Potassium Hydroxide | 3.0 | g |
| 6-Nitrobenzimidazole Nitrate | 15 | mg |
| Hydroxyethyl Cellulose (highly viscous product) | 5.0 | g |
| Titanium Dioxide | 4.5 | g |

Good composites were prepared using Light-Intercepting Elements A, B, C and D in the combination with Image-Receiving Element M with Processing Solution P and the combination of Image-Receiving Element N with Processing Solution Q.

EXAMPLE 2

Light-sensitive elements were prepared as follows.

[Light-Sensitive Element U]

A light-sensitive element was prepared by coating, in sequence, the following 9 layers on a 110 μ-thick, transparent cellulose acetate film base containing both triphenyl phosphate and dimethoxyethyl phthalate as plasticizers.

1. A gelatin layer containing dispersed therein a yellow dye image-forming material, 1-(o-carboxyphenyl)-3-carboanilide-4-[p-(β-hydroquinonylethyl)-phenylazo]-5-hydroxypyrazole lactone, at a coverage of 30 mg/100 $cm^2$, N,N-diethyllaurylamide at a coverage of 6 mg/100 $cm^2$ and gelatin at a coverage of 47 mg/100 $cm^2$.

2. A blue-sensitive silver bromoiodide emulsion (iodide content: 4.5 mol%; mean particle size: 0.8 μ), coated at a coverage of 25 mg/100 $cm^2$ as silver and 36 mg/100 $cm^2$ in gelatin.

3. A yellow filter layer containing yellow colloidal silver, coated at a coverage of 7 mg/100 $cm^2$ as silver and 20 mg/100 $cm^2$ as gelatin.

4. A gelatin layer containing dispersed therein a magenta dye image-forming material, 1-acetoxy-4-isopropoxy-2-[p-(β-hydroquinonylethyl)phenylazo]naphthalene, at a coverage of 22 mg/100 $cm^2$, N,N-diethyllaurylamide at a coverage of 5 mg/100 $cm^2$ and gelatin at a coverage of 35 mg/100 $cm^2$.

5. A silver bromoiodide emulsion layer (iodide content: 4.9 mol%; mean grain size: 0.6 μ) rendered green-sensitive with the following optical sensitizers, coated at a coverage of 15 mg/100 $cm^2$ as silver and 20 mg/100 $cm^2$ as gelatin.

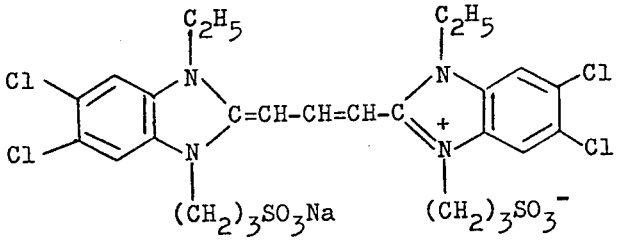

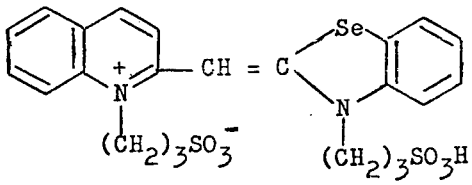

6. A layer containing 3.5 mg/100 cm² of 4'-methylphenylhydroquinone, 3.5 mg/100 cm² of di-n-butyl phthalate and 13 mg/100 cm² of gelatin.

7. A gelatin layer containing dispersed therein a cyan dye image-forming material, 1,4-bis- N-[(p-chlorophenoxy)-carbonyl][β-(hydroquinonyl-α-methyl)]-ethylamino anthraquinone, at a coverage of 12 mg/100 cm², N,N-diethyllaurylamide at a coverage of 3 mg/100 cm² and gelatin at a coverage of 18 mg/100 cm².

8. A silver bromoiodide emulsion layer (iodide content: 5.4 mol%; mean grain size: 0.6 μ) rendered red-sensitive with the following optical sensitizers, coated at a coverage of 13 mg/100 cm² as silver and 17 mg/100 cm² as gelatin.

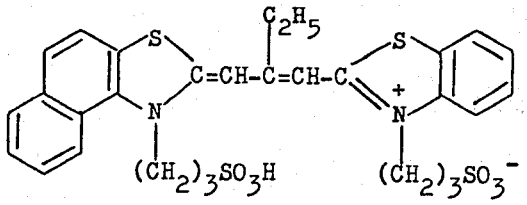

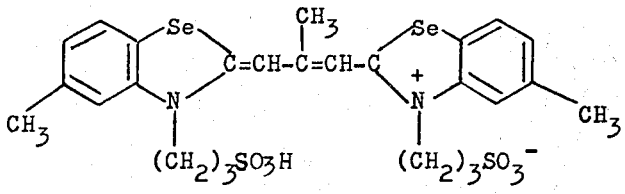

9. To 500 ml of an aqueous solution containing 50 g of lime-processed gelatin, 0.5 g of sorbitan monolaurate, 0.5 g of 1-(3-sulfo-4-phenoxyphenyl)-3-heptadecyl-5-pyrazolone lithium salt and 1 g of 4'-methylphenylhydroquinone was added 50 g of carbon black under stirring and was passed 5 times through a colloid mill at 50° C to finely disperse the carbon black. 40 ml of an aqueous solution containing 1 g of carboxymethyldimethyllaurylammonium bromide was added to the resulting dispersion and was coated in a dry thickness of 5.0 μ as the top-coating layer of the abovedescribed composite.

[Light-Sensitive Element V]

On a 70 μ-thick, transparent cellulose acetate film base containing as a plasticizer triphenyl phosphate and having as a backing layer a 3 μ-thick gelatin layer containing a dispersion of stearic acid amide and (2-hydroxy-4-tert-butylphenyl)benzotriazole were coated, in sequence, the following layers to prepare a light-sensitive element.

1. A yellow dye-forming layer containing a diffusible yellow dye-forming coupler, α-pivalyl-α-(3-octadecylcarbamyl phenylthio)-3,5-dicarboxyanilide, at a coverage of $3.5 \times 10^{-5}$ mol/100 cm², t-octylhydroquinone at a coverage of 2 mg/100 cm², tri-n-hexyl phosphate at a coverage of 20 mg/100 cm², and a chemically fogged silver bromoiodide emulsion at a coverage of $1.4 \times 10^{-4}$ mol silver/100 cm² and gelatin at a coverage of 20 mg/100 cm², the chemically fogged silver bromoiodide emulsion containing 2 mol% iodide, comprising silver bromoiodide grains of a mean grain size of 0.9 μ and being subjected to excess chemical ripening at 70° C for 120 minutes in the presence of sodium thiosulfate so that the emulsion could be developed without exposure.

2. A blue-sensitive emulsion layer containing a yellow color-forming coupler, α-(2-methylbenzoyl)-α-(N-phthalimido)-2-chloro-5-dodecyloxycarbonylacetanilide at a coverage of $3.5 \times 10^{-6}$ mol/100 cm², a development inhibitor-releasing coupler, α-pivalyl-α-(1-phenyl-5-tetrazolylthio)-2-chloro-5-[γ-(2,4-di-t-amylphenoxy)-butyramido]-acetanilide, at a coverage of $4.0 \times 10^{-5}$ mol/100 cm², di-n-butyl phthalate at a coverage of 3 mg/100 cm², gelatin at a coverage of 1.6 mg/100 cm ² and a blue-sensitive high speed negative silver bromoiodide emulsion (iodide content: 5.0 mol%; mean grain size: 1.1 μ) at a coverage of $7.5 \times 10^{-5}$ mol/100 cm² as silver.

3. An interlayer containing Carey Lee-type yellow colloidal silver at a coverage of 7.0 mg silver/100 cm², an extremely low sensitive silver bromoiodide emulsion (iodide content: 25.0 mol%; mean grain size: 0.1 μ) at a coverage of 2.2 mg silver/100 cm², 2,5-di-t-octylhydroquinone at a coverage of 3 mg/100 cm² and gelatin at a coverage of 13 mg/100 cm².

4. A magenta dye-forming layer containing a diffusible magenta dye-forming coupler, 1-(2,4,6-trichlorophenyl)-3-(3,5-dicarboxyanilino)-4-(3-octadecylcarbamylphenylthio)-5-pyrazolone, at a coverage of $2.5 \times 10^{-5}$ mol/100 cm², t-octyl-hydroquinone at a coverage of 2 mg/100 cm², tri-n-hexyl phosphate at a coverage of 7 mg/100 cm², a silver bromoiodide emulsion chemically fogged in the same manner as described for layer (1) at a coverage of $1.1 \times 10^{-4}$ mol silver/100 cm², and gelatin at a coverage of 16 mg/100 cm².

5. A green-sensitive emulsion layer containing a magenta-forming coupler, 1-phenyl-3- 3-[α-(2,4-di-sec-amylphenoxy)-butyramido]phenylureido -5-pyrazolone, at a coverage of $3.0 \times 10^{-6}$ mol/100 cm², a development inhibitor-releasing coupler, 1- 4-[α-(2,4-di-t-amylphenoxy)butyramido]-phenyl -3-piperidino-4-(1-phenyl-5-tetrazolylthio)-5-pyrazolone, at a coverage of $3.0 \times 10^{-6}$ mol/100 cm², tri-o-cresyl phosphate at a coverage of 2.5 mg/100 cm², and a green-sensitive high speed negative type silver bromoiodide emulsion (iodide content: 5.6 mol%; mean grain size: 0.9 μ) at a coverage of $9.5 \times 10^{-5}$ mol silver/100 cm² and 18 mg gelatin/100 cm², the silver bromoiodide emulsion being sensitized with the following optical sensitizers.

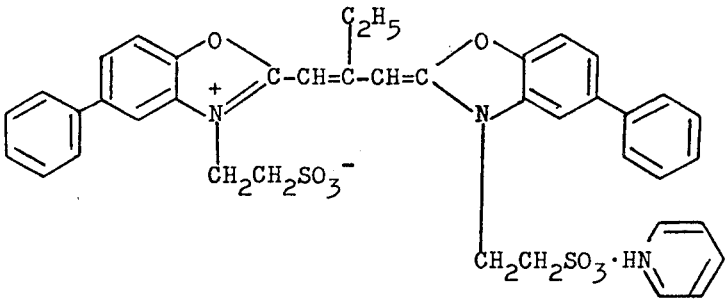

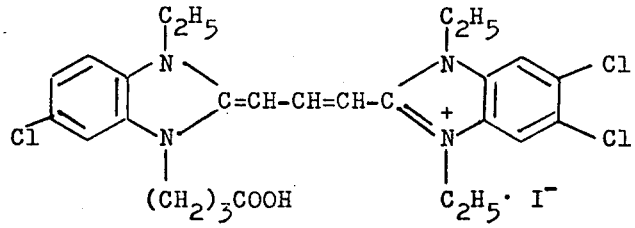

6. An interlayer containing Carey Lee-type yellow colloidal silver at a coverage of 3.5 mg silver/100 cm², an extremely low sensitive silver bromoiodide emulsion (iodide content: 25.0 mol%; mean grain size: 0.1 μ) at a coverage of 2.2 mg silver/100 cm², 2,5-di-t-octylhydroquinone at a coverage of 3 mg/100 cm² and gelatin at a coverage of 13 mg/100 cm².

7. A cyan dye-forming layer containing a diffusible cyan dye-forming coupler, 1-hydroxy-4-(3-octadecylcarbamylphenylthio)-N-ethyl-3',5'-dicarboxy-2-naphthanilide, at a coverage of $2.8 \times 10^{-5}$ mol/100 cm², t-octylhydroquinone at a coverage of 1.5 mg/100 cm², N,N-diethyllaurylamide at a coverage of 7 mg/100 cm², the same chemically fogged silver bromoiodide emulsion as described for layer (1) at a coverage of $1.1 \times 10^{-4}$ mol silver/100 cm², and gelatin at a coverage of 20 mg/100 cm².

8. A red-sensitive emulsion layer containing a cyan-forming coupler, 1-hydroxy-4-chloro-3'-chloro-5'-dodecyloxycarbonyl-2-naphthanilide, at a coverage of $3.5 \times 10^{-6}$ mol/100 cm², a development inhibitor-releasing coupler, 1-hydroxy-4-(1-phenyl-5-tetrazolylthio)-N-[γ-(2,4-di-t-amylphenoxy)propyl]-2-naphthamide, at a coverage of $4.0 \times 10^{-6}$ mol/100 cm², di-n-butyl phthalate at a coverage of 3 mg/100 cm², and a red-sensitive high speed negative type silver bromoiodide emulsion (iodide content: 5.6 mol%; mean grain size: 0.9 μ) sensitized with the following optical sensitizers, at a coverage of $7.5 \times 10^{-5}$ mol silver/100 cm² and 18 mg gelatin/100 cm².

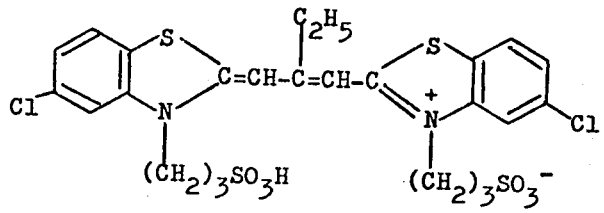

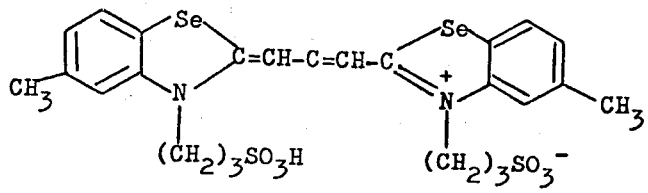

The above-described layers (1) through (8) were hardened by incorporating 4-chloro-6-hydroxy-s-triazinyl-2-gelatin, prepared according to the description in Example 1 of U.S. Pat. No. 3,362,827, in an amount of 8% by weight based on the gelatin.

On the resulting composite were further coated the hardener-free layers described below.

9. A gelatin layer at a coverage of 6.5 mg/100 cm².

10. A layer formed according to Example 2 of U.S. Pat. No. 3,459,563 by coating a black colloidal silver dispersion containing 5.0 g of gelatin and 2.5 g of silver per 100 g of gelatin.

Each of these light-sensitive elements was cut into an 84 × 83 mm rectangle and connected, at the 84 mm length edge, to a thin, smooth leader paper of a width of 75 mm and a length of 140 mm. On the opposite edge was pasted a 84 × 7 mm porous paper as an excess solution reservoir. The head of the leader paper penetrated the composite through the rear end and between the light-intercepting element and the image-receiving element so that the light-sensitive element, upon pulling the leader paper, was in contact with the image-receiving element at the coated surfaces, and then the leader paper was removed at the leading end of the composite between the leading end of the light-intercepting element and the processing solution container. Thus, a film unit was assembled. In this case, a composite containing Image-Receiving Element M and Processing Solution P was used for Light-Sensitive Element U, whereas a composite containing Image-Receiving Element N and Processing Solution Q was used for Light-Sensitive Element V.

These film units were loaded, as illustrated in FIG. 2, in a camera containing a pair of pressure-applying rollers. At this point, the light-sensitive element was disposed with its transparent support directed toward the lens, and the image-receiving element/light-intercepting element composite was disposed behind a pressure plate with the image-receiving element directed toward the lens. After photographing, the leader paper was pulled to insert the light-sensitive element into a definite position in the composite. Then, the film unit was passed through pressure-applying rollers, followed by processing at about 25° C under an illumination of about 10,000 1x. 20 minutes after the initiation of the processing, the reflection density at the darkest area of the print obtained was measured to obtain the following results tabulated below.

| Light-Sensitive Element | | U | | | V | | |
|---|---|---|---|---|---|---|---|
| Image-Receiving Element | | M | | | N | | |
| Processing Solution | | P | | | Q | | |
| | | Maximum Density | | | Maximum Density | | |
| | | $D_B$ | $D_G$ | $D_R$ | $D_B$ | $D_G$ | $D_R$ |
| Light-Intercepting Element | A | 1.4 | 1.5 | 1.6 | 1.5 | 1.5 | 1.9 |
| | B | 1.5 | 1.5 | 1.6 | 1.5 | 1.5 | 1.6 |
| | C | 1.5 | 1.5 | 1.7 | 1.5 | 1.4 | 1.6 |
| | D | 1.4 | 1.4 | 1.6 | 1.4 | 1.4 | 1.6 |
| | Blank (transparent base) | 0.4 | 0.5 | 0.3 | 0.3 | 0.3 | 0.2 |

The above-described results demonstrates that the film unit of the present invention containing the composite protected by the light-intercepting elements ensures the interception of light during processing, whereby a desired transfer density can be attained.

EXAMPLE 3

Image-Receiving Element O was formed as the 4th layer on Image-Receiving Layer M by applying the following mixture thereto in a dry thickness of 12 $\mu$.

50 grams of polyvinyl alcohol (saponification degree: 99%; mean molecular weight: about 200,000) was dissolved in 550 ml of water under heating, and 200 g of titanium dioxide (anatase type) was added thereto, followed by stirring for 5 hours using a kneader to disperse. To this mixture was added 250 ml of water containing 0.4 g of polyethyleneoxy (20) sorbitan monooleate and 1 g of hexamethylol melamine.

Processing solution R was prepared by replacing titanium dioxide in Processing Solution P by 25.0 g of carbon black (furnace type carbon black subjected to an oxidative surface treatment; mean particle size: 27 m$\mu$) and sealed in a container.

In a manner similar to Example 1, an image-receiving element/light-intercepting element composite was assembled using Image-Receiving Element O, Light-Intercepting Element C and Processing Solution R.

Then, Light-Sensitive Element W was prepared in a similar manner as with Light-Sensitive Element U except for adjusting the thickness of the top-coating light-intercepting layer to 1.5 $\mu$. A leader paper and an excess solution reservoir were fixed to the light-sensitive element as described in Example 2 to assemble a film unit, which was then exposed and processed. Thus, the following maximum reflection densities were obtained: $D_B$ 1.6; $D_G$ 1.5; $D_R$ 1.7.

EXAMPLE 4

Both sides of Image-Receiving Element M (110 × 90 mm) were bordered by a 80 $\mu$-thick, white, pressure-sensitive tape covering the element begining 90 mm from the rear end (3mm on the image-receiving layer side and 5 mm on the support side). On the white tape of the image-receiving layer side a strip of cellulose acetate (3 mm × 90 mm × 50 $\mu$) containing carbon black was fixed as a spacer.

Light-Intercepting Element B (90 × 90 mm) was superposed thereon, and only the area corresponding to the spacer was adhered to prepare a composite having the cross section as illustrated in FIG. 12. The spacer was fixed by heat adhesion using an adhesive layer comprising carbon black and polyvinyl acetate. A film unit was assembled in the same manner as described in Example 2 using Light-Sensitive Element V (84 × 83 mm) having a leader paper and an excess solution reservoir and the above-described composite. Upon imagewise exposure and development processing, formation of transferred positive images was observed through the transparent support of the image-receiving element.

About one month after the processing, the light-intercepting element and then the light-sensitive element were delaminated from the film unit and immersed in warm water at 45° C for 5 minutes to thereby remove the light-intercepting layer, followed by the following processings.

After these processings, a negative color image was found to be formed in the dried light-sensitive element, which could be used as an original for ordinary color prints.

| | | |
|---|---|---|
| After-Processings: | | |
| 1. Alkaline Processing Bath | 24° C | 5 min. |
| 2. Bleaching Bath | 24° C | 6 min. |
| 3. Fixing Bath | 24° C | 4 min. |
| 4. Washing | 16° C | 10 min. |
| 1. Alkaline Processing Bath | | |
| Sodium Carbonate | | 30 g |
| Sodium Hydrogen Carbonate | | 5 g |
| Water to make | | 1 liter |
| 2. Bleaching Bath | | |
| Potassium Ferricyanide | | 30 g |
| Potassium Ferrocyanide | | 8 g |
| Potassium Bromide | | 20 g |
| Borax (5 $H_2O$) | | 15 g |
| Boric Acid | | 5 g |
| Disodium Ethylenediamine-tetraacetate (dihydrate) | | 1 g |
| Water to make | | 1 liter |
| 3. Fixing Bath | | |
| Sodium Hexametaphosphate | | 1 g |
| Sodium Bisulfite | | 5 g |
| Sodium Thiosulfate | | 150 g |
| Acetic Acid | | 8 ml |
| Water to make | | 1 liter |

While the invention has been described in detail and with reference to specific embodiments thereof, it will be apparent to one skilled in the art that various changes and modifications can be made therein without departing from the spirit and scope thereof.

What is claimed is:

1. A diffusion transfer color photographic film unit, a. which contains:

1. a light-sensitive element comprising a transparent support having thereon at least one light-sensitive silver halide emulsion layer having associated therewith a dye image-forming material which, as a result of development, forms an imagewise distribution of a dye image-forming material capable of diffusing through a processing solution;
2. an image-receiving element comprising a transparent support having thereon an image-receiving layer for receiving the dye image-forming material upon diffusion;
3. a light-intercepting element having substantially the same area as the image-receiving element and being capable of protecting an emulsion layer or layers from external light during development processing of the film unit in a bright place out of a camera;
4. a rupturable container retaining an alkaline processing solution and capable of spreading the processing solution between the emulsion layer and the image-receiving layer in a layer form upon rupture by means of pressure-applying members; and
5. a light-reflecting substance in an amount sufficient to form a white background for the transferred dye images, the light-reflecting substance being positioned between the image-receiving layer and the light-sensitive emulsion layer of the light-sensitive element, said light-reflecting substance being located in a layer coated on the image-receiving layer, in the alkaline processing solution, or in combinations of these locations, b. in which the image-receiving element and the light-intercepting element are relatively fixed at least at one edge in a parallel face-to-face alignment, with the image-receiving layer directed inside, to form a composite having an opening for introducing the light-sensitive element therebetween after imagewise exposure thereof at a location outside the composite so that the image-receiving layer faces the light-sensitive emulsion layer of the light-sensitive element, c. means for placing said light-sensitive element into said composite after imagewise exposure, and d. said film unit being adapted to be passed, after imagewise exposure of the light-sensitive element and introduction of the light-sensitive element through the opening of the composite, through pressure-applying members.

2. The film unit as described in Claim 1, including a neutralizing layer containing a sufficient quantity of an acid for substantially neutralizing the alkaline processing solution when spread, said neutralizing layer being positioned either between the transparent support of the light-sensitive element and the emulsion layer of the light-sensitive element or between the transparent support of the image-receiving element and the image-receiving layer.

3. The film unit as described in claim 2, wherein said neutralizing layer contains a sufficient quantity of an acid for neutralizing that after substantial completion of dye image formation the alkaline processing solution is neutralized to a pH at which the dye image-forming step substantially ceases.

4. The film unit as described in claim 2, wherein said neutralizing layer contains an acid in an amount equivalent to or greater than the amount of alkali contained in the spread processing solution layer.

5. The film unit as described in claim 2, wherein said neutralizing layer contains a carboxy group or sulfone group containing polymer.

6. The film unit as described in claim 1, wherein said light-sensitive element further includes a processing solution permeable light-intercepting layer coated on the light-sensitive emulsion layer or emulsion layers of the light-sensitive element and containing a light absorbent in an amount sufficient to protect the light-sensitive emulsion layer or emulsion layers of the light-sensitive element from external light during processing the film unit outside a camera.

7. The film unit as described in claim 6, including a processing solution permeable layer covering said light-intercepting layer and containing at least part of the light-reflecting substance.

8. The film unit as described in claim 1, wherein said processing solution contains at least part of the light-reflecting substance.

9. The film unit as described in claim 1, including processing solution permeable layer covering the image-receiving layer and containing at least part of the light-reflecting substance.

10. The film unit as described in claim 1, including, in sequence, on the image-receiving layer a processing solution permeable layer containing a sufficient amount of the light-reflecting substance and a processing solution permeable layer containing a light absorbent in an amount sufficient to protect the light-sensitive emulsion layer or layers of the light-sensitive element from external light during development-processing of the film unit outside a camera.

11. The film unit as described in claim 1, wherein said processing solution contains a light-reflecting substance and a dye which is substantially colorless at a pH less than the pKa of the dye and becomes colorless at a pH higher than the pKa of the dye in an amount sufficient to protect the light-sensitive emulsion layer or layers of the light-sensitive element from external light during development-processing of the film unit outside a camera.

12. The film unit as described in claim 1, wherein said dye image-forming material is a dye containing a group capable of developing.

13. The film unit as described in claim 12, wherein said group capable of developing silver halide is an o-dihydroxyphenyl group or a p-dihydroxyphenyl group.

14. The film unit as described in claim 1, wherein said dye image-forming material is a compound capable of releasing a diffusible dye upon reaction with the oxidation product of a silver halide developing agent.

15. The film unit as described in claim 14, wherein said developing agent is an aromatic primary amine developing agent.

16. The film unit as described in claim 14, wherein said developing agent is in the processing solution.

17. The film unit as described in claim 1, including at least one emulsion layer wherein the dye image absorption wavelength region of the dye image-forming material substantially coincides with the light-sensitive wavelength region of the silver halide emulsion associated therewith.

18. The film unit as described in claim 17, including a blue light-sensitive emulsion, a green light-sensitive emulsion and a red light-sensitive emulsion having dye-image-forming materials with corresponding absorptions, respectively, associated therewith.

19. The film unit as described in claim 1, wherein said means for placing said light-sensitive element in said composite is a leading sheet connected to one end of the light-sensitive element, said leading sheet penetrating the composite in such manner that the leading sheet passes through the opening and between the image-receiving element and the light-intercepting element.

20. The film unit as described in claim 1, wherein the light-sensitive element, the image-receiving element and the light-intercepting element which undergo frictional contact have antistatic processed or sliding property-imparting processed surfaces, or both.

21. The film unit as described in claim 1, wherein said light-intercepting element comprises a dimensionally stable layer and a light absorbent.

22. The film unit as described in claim 21, wherein said dimensionally stable layer is selected from the group consisting of paper, metal foil, and polymer film.

23. The film unit as described in claim 21, wherein said light absorbent is carbon black.

24. The film unit as described in claim 21, wherein said light absorbent is either contained in or coated on the dimensionally stable layer.

25. The film unit as described in claim 1, wherein said rupturable container is attached to said light-intercepting element.

26. The film unit as described in claim 1, wherein said light-sensitive silver halide emulsion layer includes aromatic primary amino developing agents selected from the group consisting of 2-chloro-4-aminophenol, 2-6-dibromo-4-aminophenol, 4-amino-N,N-diethyl-3-methylaniline, N,N-diethyl-p-phenylenediamine, N-ethyl-β-methanesulfonamidoethyl-3-methyl-4-aminoaniline, 4-amino-N-ethyl-N-(δ-sulfobutyl)-aniline, 4-amino-N-ethyl-N-(β-hydroxyethyl)aniline, 4-amino-3-methyl-N-ethyl-N-(β-hydroxyethyl)aniline, 4-amino-N-ethyl-N-(β-carboxyethyl)aniline, 4-amino-N,N-bis(β-hydroxyethyl)-3-methylaniline, 3-acetamido-4-amino-N,N-(β-hydroxyethyl)aniline, 4-amino-N-ethyl-N*(2,3-dihydroxypropyl)-3-methylaniline, 4-amino-N,N-diethyl-3-(3-hydroxypropoxy)aniline, 4-amino-N-ethyl-N-(β-hydroxyethyl)-3-methoxyaniline, and the salts of these anilines.

27. The film unit as described in claim 1, wherein said light-sensitive silver halide emulsion layer includes a solvent which is substantially insoluble in water and has a boiling point of not less than about 200° C at atmospheric pressure.

28. The film unit as described in claim 27, wherein said solvents are selected from the group consisting of fatty acid esters, phthalic esters, phospheric esters and amides.

29. The film unit as described in claim 27, further including a polymer having an affinity for the solvent selected from the group consisting of shellac, phenol-formaldehyde condensates, poly-n-butyl acrylate, n-butyl acrylate-acrylic acid copolymers, and n-butyl acrylate-styrenemethacrylamide copolymers.

30. The film unit as described in claim 1, wherein said processing solution in said rupturable container includes water and an alkali selected from the group consisting of sodium hydroxide, potassium hydroxide, a calcium hydroxide dispersion, tetramethylammonium hydroxide, sodium carbonate, trisodium phosphate, and diethylamine.

31. The film unit as described in claim 30, wherein said processing solution further contains a hydrophilic polymer for imparting a viscosity thereto of between about 1 and about 1,000 poises at room temperature.

32. The film unit as described in claim 30, wherein said rupturable container further includes a light absorbent and a desensitizer.

33. The film unit as described in claim 30, wherein said rupturable container further includes one or more of an auxiliary developing agent, an onium development accelerator, an antifogging agent, an anti-oxidizing agent, and a silver halide solvent.

34. The film unit as described in claim 1, wherein said image-receiving layer contains a basic polymer selected from the group consisting of poly-4-vinylpyridine, a polymer of the aminoguanidine derivative of vinyl methyl ketone, poly-4-vinyl-N-benzyl-pyridinium p-toluenesulfonate, poly-3-vinyl-4-methyl-N-n-butyl-pyridinium bromide, a styrene/N-(3-maleimidopropyl)-N,N-dimethyl-N-(4-phenylbenzylammonium chloride) copolymer and poly N-(2-methacryloylethyl)-N,N-dimethyl-N-benzylammonium chloride. 3

35. The film unit as described in claim 1, wherein said image-receiving layer contains a basic surface active agent selected from the group of N-lauryl-pyridinium bromide, cetyltrimethylammonium bromide, methyl-tri-n-lauryl-ammonium p-toluenesulfonate, methyl-ethyl-cetylsulfonium iodide, and benzyltriphenylphosphonium chloride.

36. The film unit as described in claim 1, wherein said image-receiving layer includes multivalent metals selected from the group consisting of thorium, aluminum and zirconium, and polymers selected from the group consisting of gelatin, polyvinyl alcohol, polyacrylamide, polyvinyl methyl ether, hydroxyethyl cellulose, N-methoxymethylpolyhexylmethyleneadipamide, and polyvinyl pyrrolidone.

37. The film unit as described in claim 1, wherein said image-receiving layer includes a developing agent scavenger which reacts with excess developing agent remaining after the processing to form a colorless product which is difficult to oxidize.

38. The film unit as described in claim 2, wherein said neutralizing layer includes a developing agent scavenger which reacts with excess developing agent remaining after the processing to form a colorless product which is difficult to oxidize.

39. The film unit as described in claim 2, further including a neutralization rate-adjusting layer coated on the neutralization layer which prevents an unfavorable reduction in the transfer image density due to a too fast reduction in the pH before the necessary development of silver halide emulsion layer and the formation of the diffusion transfer image are completed.

40. The film unit as described in claim 39, wherein said neutralization rate-adjusting layer is $2\mu$ to $20\mu$ in thickness and is composed of hardened polymers selected from the group of gelatin, polyvinyl alcohol, polyvinyl propyl ether, polyacrylamide, hydroxypropylmethyl cellulose, isopropyl cellulose, partial butyrated polyvinyl alcohol, partically hydrolyzed polyvinyl acetate and a copolymer of $\beta$-hydroxyethyl methacrylate and ethyl acrylate.

41. The film unit as described in claim 1, wherein said light-sensitive silver halide emulsion layer includes diffusible dye-releasing couplers.

42. The film unit as described in claim 41, wherein said couplers are selected from compounds having the following formulae $$(\text{Cp-1}) - \text{L} - (\text{Fr}) \qquad (1)$$

$$\text{Cp-2}) - \text{L} - (\text{Bl}) \qquad (2)$$

wherein Cp-1 represents a coupling reaction-active structure in which the coupling position is substituted with said (Fr)-L-residue and at least one non-coupling position is substituted with a group containing a hydrophobic group having 8 or more carbon atoms and being capable of providing diffusion resistance or a ballasting property to the coupler molecule, Cp-2 represents a coupling reaction-active structure in which the coupling position is substituted with said (Bl)-L-residue and, when the coupler is used in combination with a developing agent which does not contain a water-solubilizing group, the Cp-2 group has a water-solubilizing group in at least one non-coupling position, and (Fr)-L- and (Bl)-L- represent groups which are eliminated by a developing agent once oxidized wherein Fr represents a dye structure moiety having absorption in the visible wavelength region and having at least one water-solubilizing group and Bl represents a group containing a hydrophobic group having 8 or more carbon atoms and rendering the coupler molecule diffusion resistant, and the L group is selected from an azo group, an azoxy group, a mercuryl group (-Hg-), an oxy group, a thio group, a dithio group, a triazolyl group, a diacylamino group, an acylsulfonamino group

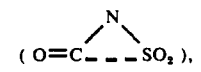

an acyloxy group, a sulfonyloxy group and an alkylidene group.

43. The film unit as described in claim 42, wherein Cp-1 and Cp-2 may be selected from the group consisting of acylamino-substituted phenols, 1-hydroxy-2-naphthoic acid amides, N,N-dialkylanilines, the 1-aryl-5-pyrazolones (with the 3-position being substituted with an alkyl group, an aryl group, an alkoxy group, an aryloxy group, an amino group, an acylamino group, ureido group or a sulfonamido group), the pyrazolobenzimidazoles, the pyrazolotriazoles, the $\alpha$-cyanoacetophenones and the $\alpha$-acylacetanilides.

44. The film unit as described in claim 42, wherein the Fr group is selected from the residues derived from azo dyes, azomethine dyes, indoaniline dyes, indophenol dyes, anthraquinone dyes, nitro dyes and azine dyes.

45. A composite structure for use in a diffusion transfer color photographic film unit which comprises:

1. an image-receiving element comprising a transparent support having thereon an image-receiving layer for receiving a dye image-forming material upon diffusion;
2. a light-intercepting element having substantially the same area as said image-receiving element and being capable of protecting an emulsion layer or layers from external light during development processing of the film unit in a bright place out of a camera; and
3. a spacing member between said image-receiving element and said light-intercepting element to provide sufficient space therebetween for the introduction of an exposed light-sensitive element, said image-receiving layer of said image-receiving element facing said light-intercepting element and being in a fixed planar parallel relationship to each other.

46. The composite structure as described in claim 45, wherein the surface of said light-intercepting element facing said image-receiving element has been subjected to antistatic processing.

47. A method of producing an image on an image-receiving element which comprises:

1. imagewise exposing a light-sensitive element comprising a transparent support having thereon at least one light-sensitive silver halide emulsion layer having associated therewith a dye image-forming material which, as a result of development, forms an imagewise distribution of a dye image-forming material capable of diffusing through a processing solution;
2. introducing the exposed light-sensitive element through the opening in a diffusion transfer color photograph composite formed from
   a. an image-receiving element comprising a transparent support having thereon an image-receiving layer for receiving the dye image-forming material upon diffusion;
   b. a light-intercepting element having substantially the same area as the image-receiving element and being capable of protecting an emulsion layer or layers from external light during development processing of the film unit in a bright place out of a camera;
   c. a rupturable container retaining an alkaline processing solution and capable of spreading the processing solution between the emulsion layer and the image-receiving layer in a layer form upon rupture by means of pressure-applying members; and
   d. a light-reflecting substance in an amount sufficient to form a white background for the transferred dye images, the light-reflecting substance being positioned between the image-receiving layer and the light-sensitive emulsion layer of the light-sensitive element, said light-reflecting substance being located in a layer coated on the image-receiving layer, in the alkaline processing solution, or in combinations of these locations, e. said image-receiving element and said light-intercepting element having a fixed opening therebetween;

3. passing the composite of (2) through pressure applying members to rupture said rupturable containers and spread the processing solution between said emulsion layer and said image-receiving layer and thereby cause development of the exposed silver halide emulsion layer resulting in the subsequent diffusion of the dye image-forming material to form an image on said image-receiving element.

48. The method as described in claim 47, wherein said imagewise exposure of said light-sensitive element is accomplished in a camera with the transparent support being directed toward the lens of the camera.

49. The film unit as described in claim 47, wherein the light-sensitive element which is imagewise exposed at a location outside the composite is introduced into the composite by the pulling of a leader member which is connected to the light-sensitive element and which is threaded through the opening of the composite.

50. The film unit as described in claim 49, wherein said composite is maintained in a stationary position while said leader member is pulled a fixed amount.

* * * * *